US006620007B2

(12) United States Patent
Kinomoto

(10) Patent No.: US 6,620,007 B2
(45) Date of Patent: Sep. 16, 2003

(54) COOLING WATER JACKET FOR SMALL WATERCRAFT ENGINE

(75) Inventor: Naoki Kinomoto, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/087,932

(22) Filed: Feb. 28, 2002

(65) Prior Publication Data

US 2002/0197919 A1 Dec. 26, 2002

(30) Foreign Application Priority Data

Feb. 28, 2001 (JP) ..... 2001-054800

(51) Int. Cl.[7] ..... B63H 21/38

(52) U.S. Cl. ..... 440/88 L; 123/196 R; 123/196 AB

(58) Field of Search ..... 440/88, 88 L; 123/196 AB, 196 R

(56) References Cited

U.S. PATENT DOCUMENTS

| | | | | |
|---|---|---|---|---|
| 4,502,424 A | * | 3/1985 | Katoh et al. | 123/41.86 |
| 5,085,188 A | * | 2/1992 | Gasparri et al. | 123/196 R |
| 5,558,244 A | * | 9/1996 | Akaike et al. | 220/374 |
| 5,647,315 A | | 7/1997 | Saito | |
| 5,809,963 A | | 9/1998 | Saito | |
| 5,899,186 A | * | 5/1999 | Kawamoto | 123/196 R |
| 5,951,343 A | | 9/1999 | Nanami et al. | |
| 6,015,320 A | | 1/2000 | Nanami | |

FOREIGN PATENT DOCUMENTS

| | | |
|---|---|---|
| JP | 07269074 | 9/1995 |
| JP | 10162586 | 6/1998 |

OTHER PUBLICATIONS

Application No. 09/815,421 filed on Mar. 22, 2001 entitled *Oil Pump Construction for Watercraft Engine* in 27 pages along with 22 sheets of formal drawings.

Application No. 09/718,820 filed on Nov. 22, 2000 entitled *Cooling System for Land Vehicles* in 25 pages along with 9 sheets of formal drawings.

Application No. 09/678,409 filed on Oct. 2, 2000 entitled *Engine Cooling System for Watercraft* in 22 pages along with 6 sheets of informal drawings.

Personal Watercraft Illustrated Magazine, *The Wait is Over*, Feb. 2002, pp. 8–13.

Personal Watercraft Illustrated Magazine, *Finally, we get our turn*, Dec. 2001, pp. 20–27.

Personal Watercraft Illustrated Magazine, *Luxury, Performance, and Peace of Mind*, Sep. 2001, pp. 10–14.

* cited by examiner

*Primary Examiner*—Sherman Basinger
(74) *Attorney, Agent, or Firm*—Knobbe, Martens, Olson & Bear, LLP

(57) ABSTRACT

A small watercraft engine having a lubrication system including a lubrication oil reservoir defining a cooling water jacket therein. A cooling system of the engine supplies cooling water to the water jacket. The water jacket includes at least one rib, and preferably a plurality of ribs, to guide the cooling water within the water jacket. The ribs may be arranged to guide cooling water from a lower portion of the water jacket to an upper portion of the water jacket through two or more generally distinct horizontal regions. Preferably, a pair of baffle arrangements are disposed within the oil reservoir. A first baffle arrangement separates the interior space of the reservoir from a breather chamber which communicates with the intake system. A second baffle arrangement is configured to generally retain oil within a lower portion of the reservoir so as to be available to a delivery port, which delivers oil to an oil pump of the engine. The delivery port desirably tapers in diameter from an upper end to a lower end to supply an ample amount of oil to the oil pump when the watercraft is leaning.

18 Claims, 29 Drawing Sheets

COOLING WATER JACKET FOR SMALL WATERCRAFT ENGINE

PRIORITY INFORMATION

This application is based on and claims priority to Japanese Patent Application No. 2001-054800, filed Feb. 28, 2001, the entire contents of which are hereby expressly incorporated by reference.

BACKGROUND OF THE INVENTION

1. Field of the Invention

The present invention relates to cooling systems for marine engines. More specifically, the present invention relates to an improved cooling water jacket arrangement within a lubrication oil reservoir.

2. Description of Related Art

Personal watercraft have become very popular in recent years. This type of watercraft is quite sporting in nature and carries one or more riders. A relatively small hull of the personal watercraft defines a rider's area above an engine compartment. An internal combustion engine powers a jet propulsion unit which propels the watercraft. The engine lies within the engine compartment in front of a tunnel formed on an underside of the hull. The jet propulsion unit, which includes an impeller, is placed within the tunnel. The impeller has an impeller shaft driven by the engine. The impeller shaft usually extends between the engine and the jet propulsion device through a bulkhead of the hull tunnel.

Four-stroke engines include lubrication systems arranged to supply lubrication oil to various portions of their engines, such as the crankshaft chamber and camshaft chamber. Desirably, a volume of lubrication oil is provided within a reservoir to be available for supply to the engine. The lubrication oil is permitted to cool upon being returned to the reservoir before again being supplied to the engine. As the oil pools in the reservoir, blow by gasses and air that have been entrained in the oil, aspirate out of the oil and collect in the reservoir. Vapor conduits can connect the lubricant reservoir with an induction system of the engine so as to draw out and dispose of the air and/or blow-by gasses.

SUMMARY OF THE PREFERRED EMBODIMENTS

One aspect of the invention includes the realization that certain vehicles, such as personal watercraft, are sufficiently maneuverable that oil within a lubricant reservoir can be displaced sufficiently violently to cause liquid oil to reach a vapor outlet in the top of the reservoir. When oil reaches the vapor outlet, it can temporarily clog a vapor conduit. Additionally, if such a vapor conduit is connected to the induction system of the engine, the liquid oil can be drawn into the induction system and thereby soil or damage induction system components.

Another aspect of the invention is directed to a watercraft having a hull and an engine supported by the hull. A lubricant reservoir defines an interior portion configured to pool lubricant for the engine and includes a vapor outlet. The watercraft, also includes a breather baffle arrangement disposed between the interior portion and the vapor outlet. The baffle arrangement includes a plurality of plates, each having an aperture, the apertures on adjacent plates being offset from eachother.

Further aspects, features and advantages of this invention will become apparent from the detailed description of the preferred embodiments which follow.

BRIEF DESCRIPTION OF THE DRAWINGS

These and other features, aspects and advantages of the present invention will now be described with reference to the drawings of preferred embodiments which are intended to illustrate and not to limit the invention. The drawings comprise 31 figures.

DETAILED DESCRIPTION OF PREFERRED EMBODIMENTS OF THE INVENTION

With reference to FIGS. 1 to 6, an overall configuration of a personal watercraft 30 will be described to assist the reader's understanding of a preferred environment of use. The watercraft 30 will be described in reference to a coordinate system wherein a longitudinal axis extends from bow to stern and a lateral axis from port side to starboard side normal to the longitudinal axis. The longitudinal axis lies in a vertical, central plane CP of the watercraft 30. In addition, relative heights are expressed as elevations in reference to the under surface of the watercraft 30. In various figures, an arrow denoted with the legend "forward" is used to denote the direction in which the watercraft travels during normal forward operation.

The watercraft 30 employs an internal combustion engine 32 configured in accordance with a preferred embodiment of the present invention. The described engine configuration has particular utility with the personal watercraft, and thus, is described in the context of the personal watercraft. The engine configuration, however, can be applied to other types of water vehicles as well, such as, for example, small jet boats.

Figure 3:
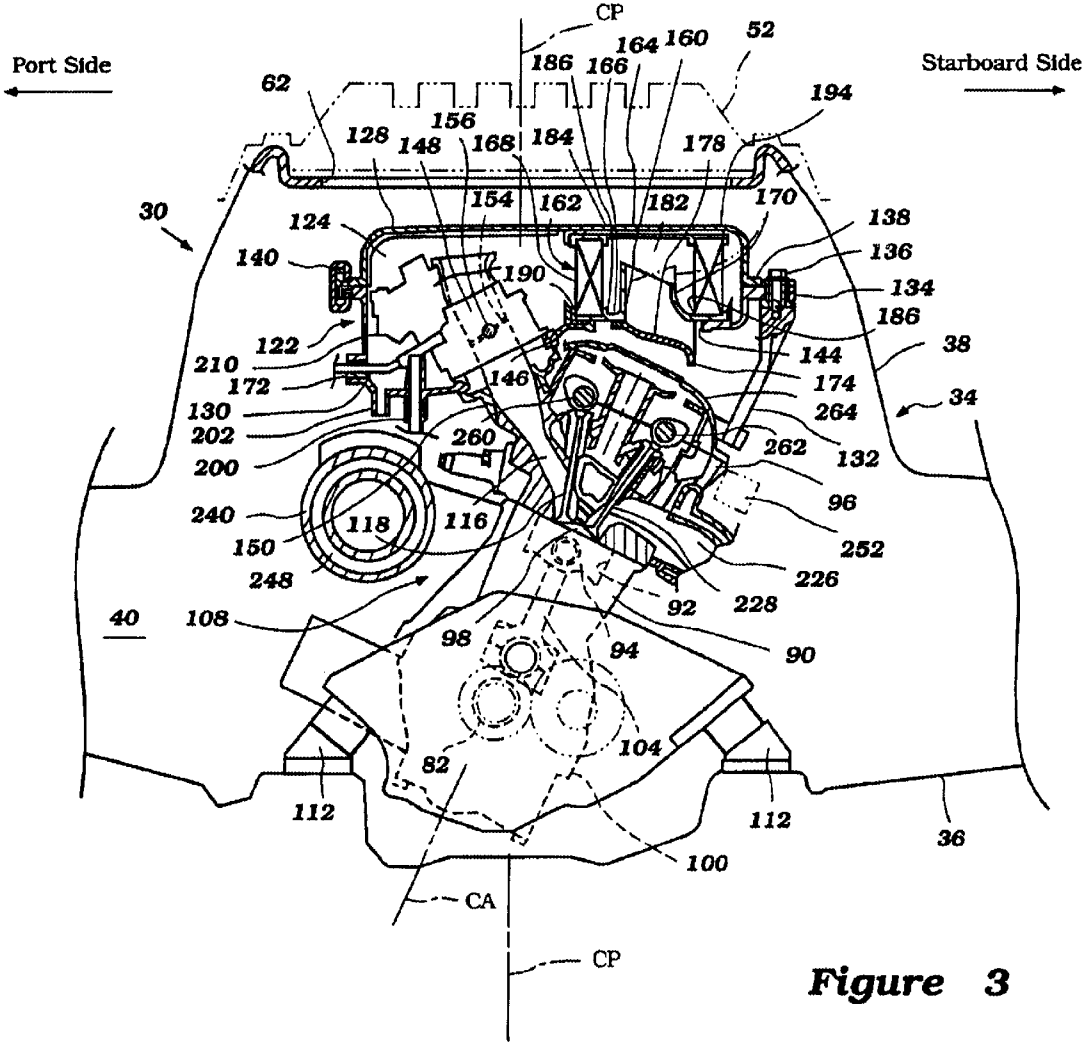
FIG. 3 is partial cross-sectional view taken from the rear of the watercraft of FIG. 1, a hull of the watercraft is illustrated schematically.

The personal watercraft 30 includes a hull 34 formed with a lower hull section 36 and an upper hull section or deck 38. Both the hull sections 36, 38 are made of, for example, a molded fiberglass reinforced resin or a sheet molding compound. The lower hull section 36 and the upper hull section 38 are coupled together to define an internal cavity 40 (FIG. 3). A bond flange 42 defines an intersection of both the hull sections 36, 38. Alternatively, the hull 34 may have a unitary construction.

Figure 1:
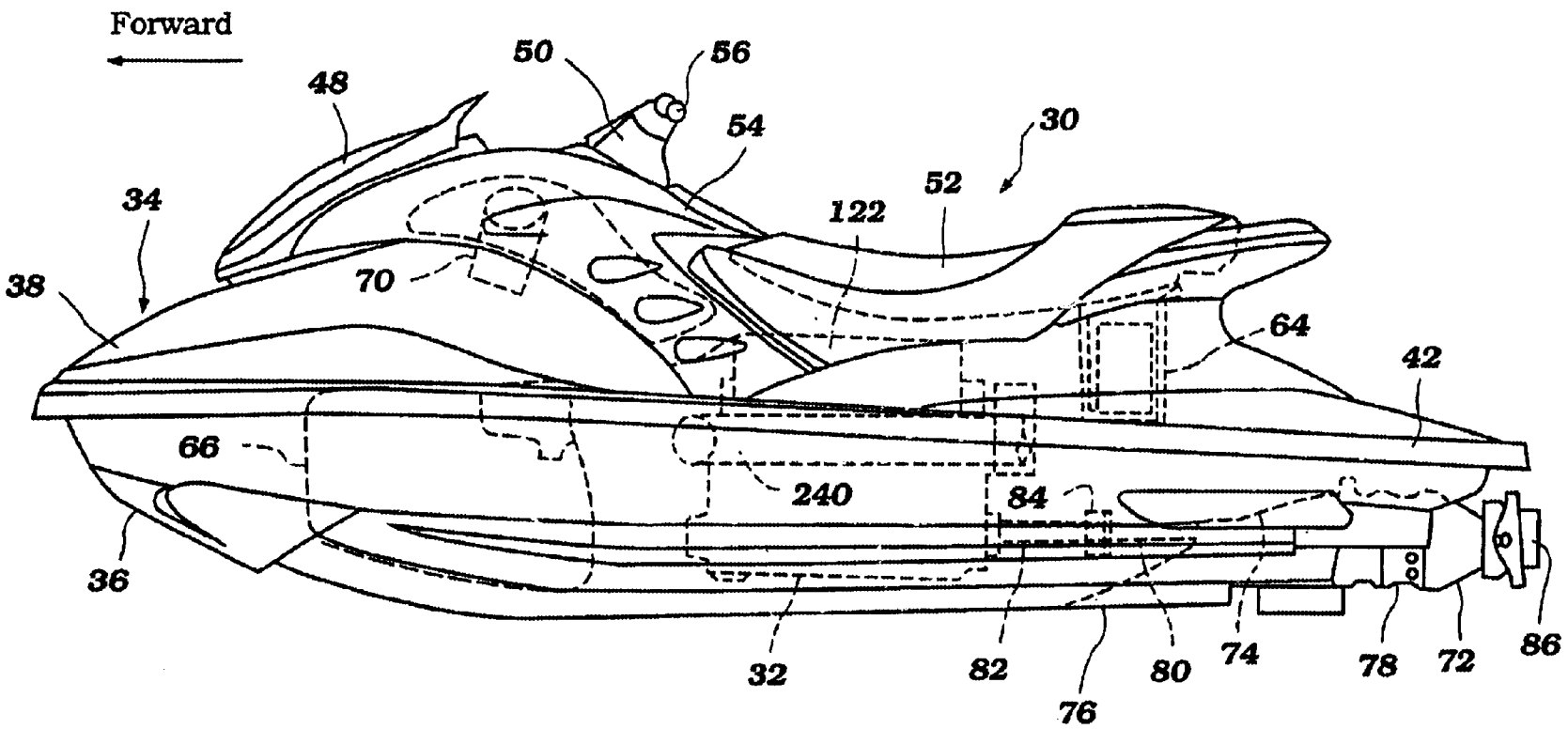
FIG. 1 is a side elevational view of a small watercraft with several internal components (e.g., an engine) shown in phantom.
Figure 2:
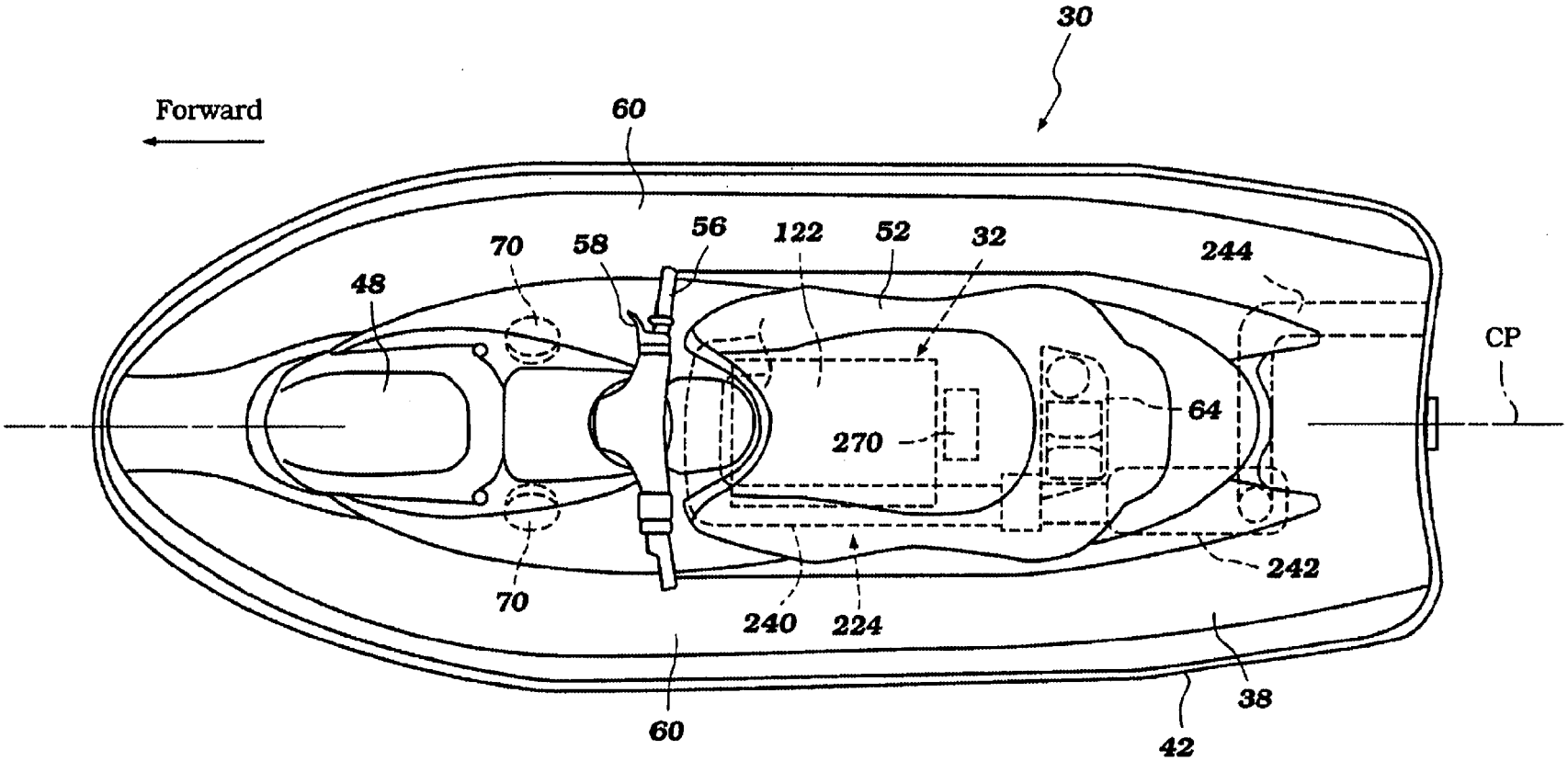
FIG. 2 is a top plan view of the watercraft of FIG. 1.

With reference to FIGS. 2 and 3, a center plane CP that extends generally vertically from a bow to a stern of the watercraft 30. Along the center plane CP, the upper hull section 34 includes a hatch cover 48, a control mast 50 and a seat 52 arranged from fore to aft.

In the illustrated embodiment, a bow portion 54 of the upper hull section 38 slopes upwardly and an opening (not shown) preferably is provided through which the rider can access the internal cavity 40. The bow portion 54 preferably is provided with a pair of cover member pieces which are apart from one another along the center plane CP. The hatch cover 48 is detachably affixed (e.g., hinged) to the bow portion 54 so as to cover the opening.

The control mast 50 extends upwardly to support a handle bar 56. The handle bar 56 is provided primarily for controlling the directions in which the water jet propels the watercraft 30. Grips are formed at both ends of the bar 56 so that the rider can hold them for that purpose. The handle bar 56 also carries other control units such as, for example, a throttle lever 58 that is used for control of running conditions of the engine 32.

The seat 52 extends along the center plane CP to the rear of the bow portion 54. The seat 52 also generally defines a rider's area. The seat 52 has a saddle shape and hence a rider can sit on the seat 52 in a straddle-type fashion. Foot areas 60 are defined on both sides of the seat 52 and at the top surface of the upper hull section 38. The foot areas 60 are formed generally flat. A cushion supported by the upper hull section 38, at least in principal part, forms the seat 52. The seat 52 is detachably attached to the upper hull section 38. An access opening 62 is defined under the seat 52 through which the rider can also access the internal cavity 40. That is, the seat 52 usually closes the access opening 62. In the illustrated embodiment, a storage box 64 is disposed under the seat 52.

A fuel tank 66 is placed in the cavity 40 under the bow portion 54 of the upper hull section 38. The fuel tank 66 is coupled with a fuel inlet port positioned at a top surface of the upper hull section 38 through a duct (not shown). A closure cap (not shown) closes the fuel inlet port. The opening disposed under the hatch cover 48 is available for accessing the fuel tank 66.

The engine 32 is disposed in an engine compartment defined in the cavity 40. The engine compartment preferably is located under the seat 52, but other locations are also possible (e.g., beneath the control mast or in the bow). The rider thus can access the engine 32 in the illustrated embodiment through the access opening 62 by detaching the seat 52.

A pair of air ducts or ventilation ducts 70 are provided on both sides of the bow portion 54 so that the ambient air can enter and exit the internal cavity 40 therethrough. Except for the air ducts 70, the engine compartment is substantially sealed so as to protect the engine 32 and other components from water.

A jet pump unit 72 propels the watercraft 30. The jet pump unit 72 includes a tunnel 74 formed on the underside of the lower hull section 36 which is isolated from the engine compartment by a bulkhead. The tunnel 74 has a downward facing inlet port 76 opening toward the body of water. A jet pump housing 78 is disposed within a portion of the tunnel 74 and communicates with the inlet port 76. An impeller is supported within the housing 78.

An impeller shaft 80 extends forwardly from the impeller and is coupled with a crankshaft 82 of the engine 32 by a coupling member 84. The crankshaft 82 of the engine 32 thus drives the impeller shaft 80. Although the impeller shaft 80 is illustrated as a single shaft, it may nonetheless be comprised of two or more shaft portions coupled to one another. Preferably, the impeller shaft 80 includes a first shaft coupled to the impeller 79 and a second shaft connecting the first impeller shaft to the crankshaft 82.

The rear end of the housing 78 defines a discharge nozzle. A steering nozzle 86 is affixed to the discharge nozzle for pivotal movement about a steering axis extending generally vertically. The steering nozzle 86 is connected to the handle bar 56 by a cable so that the rider can pivot the nozzle 86.

As the engine 32 drives the impeller shaft 80 and hence rotates the impeller, water is drawn from the surrounding body of water through the inlet port 76. The pressure generated in the housing 78 by the impeller produces a jet of water that is discharged through the steering nozzle 86. This water jet propels the watercraft 30. The rider can move the steering nozzle 86 with the handle bar 56 when he or she desires to turn the watercraft 30 in either direction.

The illustrated engine 32 operates on a four-stroke cycle combustion principle. With reference to FIG. 3, the engine 32 includes a cylinder block 90. The cylinder block 90 defines four cylinder bores 92 aligned with each other from fore to aft along the center plane CP. The engine 32 thus is an L4 (in-line four cylinder) type. The illustrated engine, however, merely exemplifies one type of engine on which various aspects and features of the present invention can be used. Engines having other number of cylinders, having other cylinder arrangements, other cylinder orientations (e.g., upright cylinder banks, V-type, and W-type) and operating on other combustion principles (e.g., crankcase compression two-stroke, diesel, and rotary) are all practicable.

Each cylinder bore 92 has a center axis CA that is slanted or inclined at an angle from the center plane CP so that the engine 32 can be shorter in height. All the center axes CA in the illustrated embodiment are inclined at the same angle.

Pistons 94 reciprocate within the cylinder bores 92. A cylinder head member 96 is affixed to the upper end of the cylinder block 90 to close respective upper ends of the cylinder bores and defines combustion chambers 98 with the cylinder bores 92 and the pistons 94.

Figure 7:
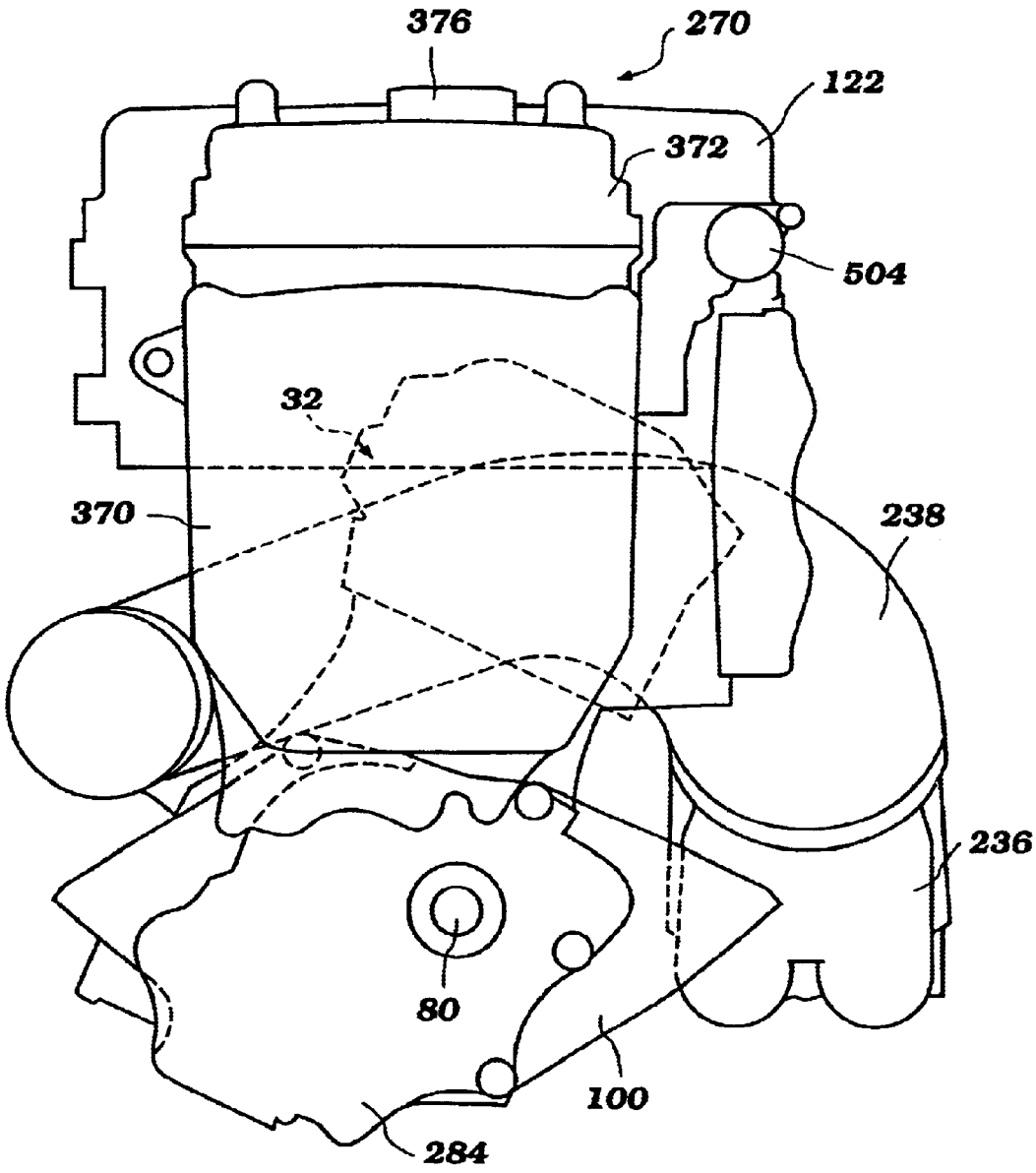
FIG. 7 is a rear elevational view of the engine showing a lubrication oil reservoir and an engine body of the engine, including a crankcase, a cylinder block and a cylinder head.

A crankcase member 100 is affixed to the lower end of the cylinder block 90 to close the respective lower ends of the cylinder bores 92 and to define a crankcase chamber 102 (FIG. 7). The crankshaft 82 is rotatably connected to the pistons 94 through connecting rods 104 and is journaled by several bearings 106 (FIG. 7) formed on the crankcase member 100. That is, the connecting rods 104 are rotatably coupled with the pistons 94 and with the crankshaft 82.

The cylinder block 90, the cylinder head member 96 and the crankcase member 100 together define an engine body 108. The engine body 108 preferably is made of an aluminum based alloy. In the illustrated embodiment, the engine body 108 is oriented in the engine compartment so as to position the crankshaft 82 generally parallel to the central plane CP and to extend generally in the longitudinal direction. Other orientations of the engine body, of course, are also possible (e.g., with a transverse or vertical oriented crankshaft).

Engine mounts 112 extend from both sides of the engine body 108. The engine mounts 112 preferably include resilient portions made of, for example, a rubber material. The engine 32 preferably is mounted on the lower hull section 36, and specifically, on a hull liner, by the engine mounts 112 so that vibrations from the engine 32 are attenuated.

The engine 32 preferably includes an air induction system configured to guide air to the combustion chambers 98. In the illustrated embodiment, the air induction system includes four air intake ports 116 (one shown) defined in the cylinder head member 96. The intake ports 116 communicate with the associated combustion chambers 98. Intake valves 118 are provided to selectively connect and disconnect the intake ports 116 with the combustion chambers 98. That is, the intake valves 118 selectively open and close the intake ports 116.

The air induction system also includes an air intake box 122 or a "plenum chamber" for smoothing intake air and acting as an intake silencer. The intake box 122 in the illustrated embodiment is generally rectangular in top plan view and defines a plenum chamber 124. Other shapes of the intake box of course are possible, but it is desired to make the plenum chamber as large as possible within the space provided in the engine compartment. In the illustrated embodiment, a space is defined between the top of the engine 32 and the bottom of the seat 52 due to the inclined orientation of the engine 32. The rectangular shape of at least a principal portion of the intake box 122 conforms to this space.

Figure 4:
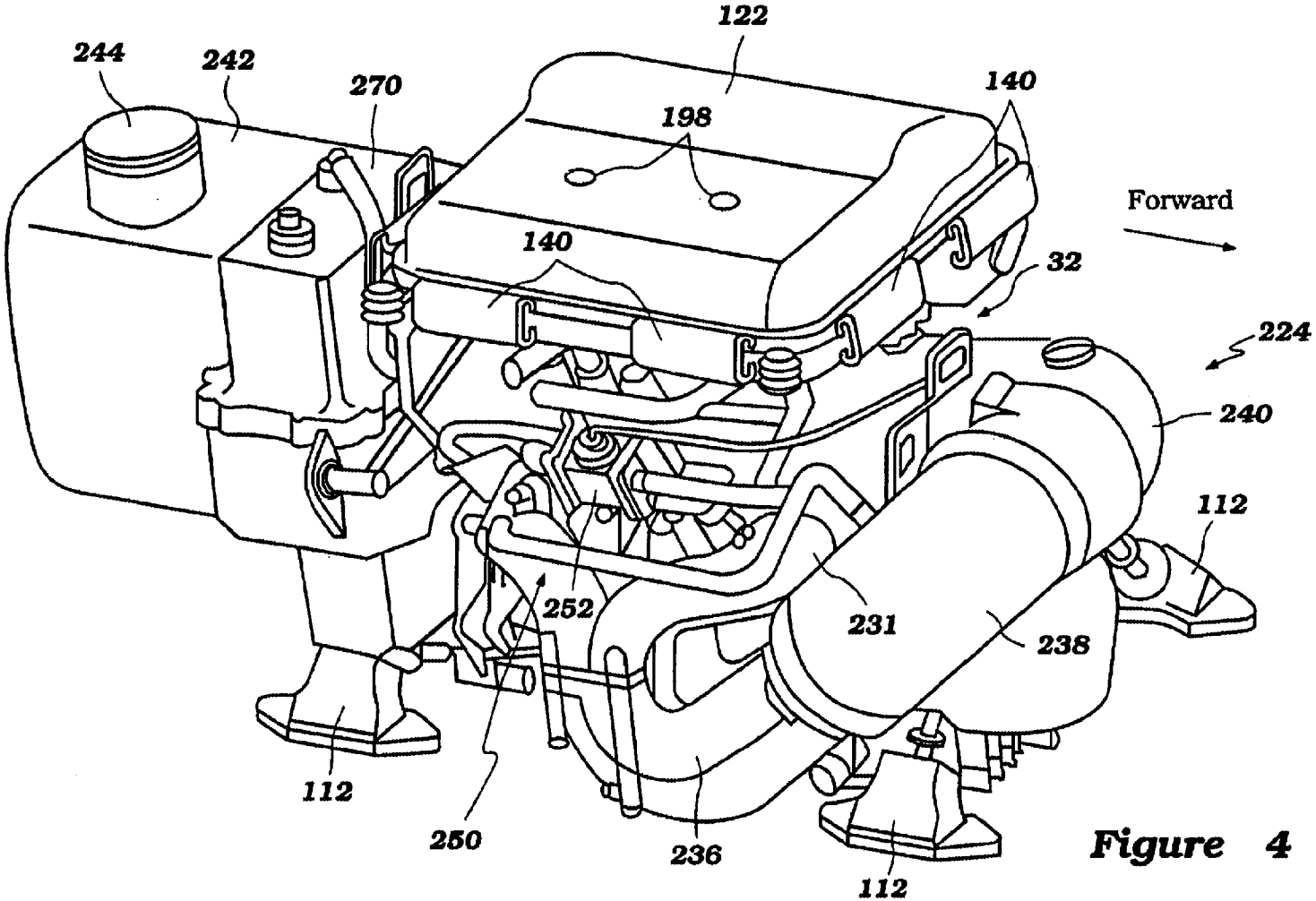
FIG. 4 is a front, top and starboard side perspective view of the engine shown in FIG. 1.
Figure 5:
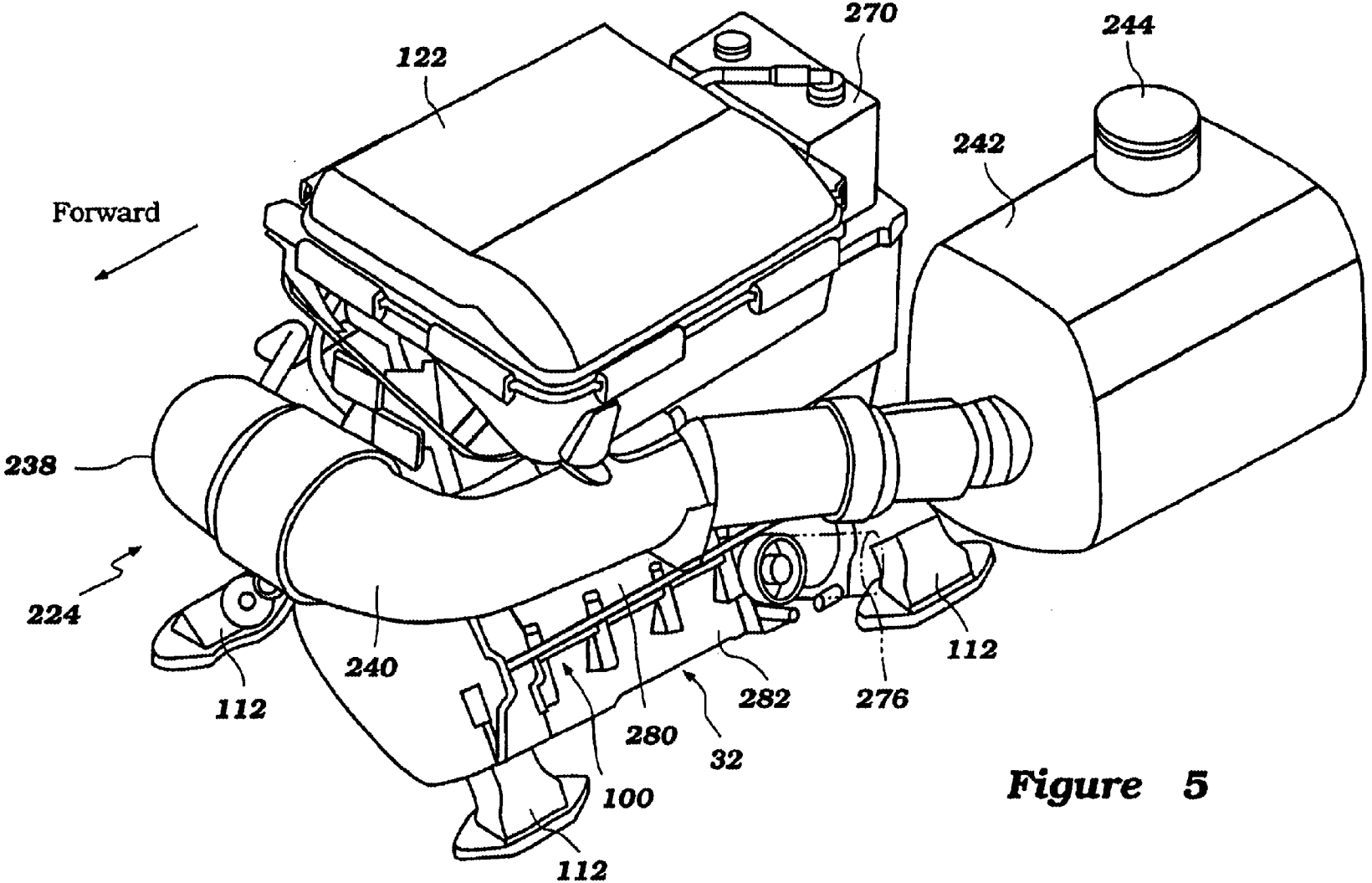
FIG. 5 is a front, top and port side perspective view of the engine shown in FIG. 1.

With reference to FIGS. 3–5, the intake box 122 comprises an upper chamber member 128 and a lower chamber member 130. The upper and lower chamber members 128, 130 preferably are made of plastic or synthetic resin, although they can be made of metal or other material. While the illustrated intake box 122 is formed by upper and lower chamber members, the chamber member can be formed by a different number of members and/or can have a different assembly orientation (e.g., side-by-side).

With reference to FIG. 3, the lower chamber member 130 preferably is coupled with the engine body 108. In the illustrated embodiment, several stays 132 (one shown) extend upwardly from the engine body 108, a flange portion 134 of the lower chamber member 130 extends generally horizontally. Several fastening members, for example, bolts 136, rigidly affix the flange portion 134 to respective top surfaces of the stays 132.

The upper chamber member 128 has a flange portion 138 that abuts the flange portion 134 of the lower member 130. Several coupling or fastening members 140, which are generally configured as a shape of the letter "C" in section, preferably put both the flange portions 134, 138 therebetween so as to couple the upper chamber member 128 with the lower chamber member 130. The intake box 122 thus is laid in a space defined between the engine body 108 and the seat 52, i.e., the rider's area of the hull 34, so that the plenum chamber 124 defines a relatively large volume therein.

The lower chamber member 130 defines an inlet opening 144 and four outlet apertures 146 (one shown). Four throttle bodies 148 (one shown) extend through the apertures 146 and preferably are fixed to the lower chamber member 130. Respective bottom ends of the throttle bodies 148 are coupled with the associated intake ports 116. Preferably, the position at which the apertures 146 are sealed to the throttle bodies 148 are spaced from the outlet of "bottom" ends of the throttle bodies 148. Thus, the lower member 130 is spaced from the engine 32, thereby attenuating transfer of heat from the engine body 108 into intake box 122.

Preferably, the throttle bodies 148 slant toward the port side oppositely the center axis CA of the engine body 108. A rubber boot 150 extends between the lower chamber member 130 and the cylinder head member 96 so as to generally surround a portion of the throttle bodies 148 which extend out of the plenum chamber 124. Respective top ends of the throttle bodies 148, in turn, open upwardly within the plenum chamber 124. Air in the plenum chamber 124 thus is drawn to the combustion chambers 98 through the throttle bodies 148 and the intake ports 116 when negative pressure is generated in the combustion chambers 98. The negative pressure is generated when the pistons 94 move toward the bottom dead center from the top dead center.

Each throttle body 148 includes a throttle valve 154 (one shown). A throttle valve shaft 156 journaled for pivotal movement, links the entire throttle valves 154. Pivotal movement of the throttle valve shaft 156 is controlled by the throttle lever 58 on the handle bar 56 through a control cable that is connected to the throttle valve shaft 156. The control cable can extends into the intake box 122 through a through-hole 172 defined at a side surface of the lower chamber member 130. The rider thus can control opening amount of the throttle valves 154 by operating the throttle lever 56 so as to obtain various running conditions of the engine 32 that the rider desires. That is, an amount of air passing through the throttle bodies 148 is controlled by this mechanism and delivered to the respective combustion chambers 98. In order to sense positions of the throttle valves 154, a throttle valve position sensor (not shown) preferably is provided at one end of the throttle valve shaft 156.

Air is introduced into the plenum chamber 124 through a pair of air inlet ports 160. In the illustrated embodiment, a filter assembly 162 separates the inlet ports 160 from the plenum chamber 124. The filter assembly 162 comprises an upper plate 164, a lower plate 166 and a filter element 168 interposed between the upper and lower plates 164, 166.

The lower plate 166 includes a pair of ducts 170 (one shown) extending inwardly toward the plenum chamber 124. The ducts 170 form the inlet ports 160. The ducts 170 are positioned generally above the cylinder head member 96. Upper ends of the ducts 170 slant so as to face an inner wall portion of the intake box 122 existing opposite the throttle bodies 148. In the illustrated embodiment, the upper or inlet ends of the ducts 170 define a high point proximate to the outlet apertures 146 and a low point distal from the apertures 146. This is advantageous because water or water mist, if any, is likely to move toward this inner wall portion rather than toward the throttle bodies 148. If, however, a smooth flow of air is desired more than the water inhibition, the upper ends of the ducts 170 can slant toward the throttle bodies 148 as indicated by the phantom line of FIG. 3.

In the illustrated embodiment, a guide member 174 is affixed to the lower plate 166 immediately below the ducts 170, preferably by several screws (not shown). The guide member 174 defines a pair of recesses 178 (FIG. 8) that are associated with the respective ducts 170. The recesses 178 open toward the starboard side. The air in the cavity 40 of the engine compartment thus is drawn into the plenum chamber 124 along the recesses 178 of the guide member 174 and then through the ducts 170.

The filter assembly 162 including the lower plate 166 is generally rectangular in shape in a plan view. The filter element 168 extends along a periphery of the rectangular shape so as to have a certain thickness from a peripheral edge. The ducts 170 open to a hollow 182 defined by the filter element 168. The air in this hollow 182 thus cannot reach the throttle bodies 148 without passing through the filter element 168. Foreign substances in the air are removed by the filter element 168 accordingly.

Preferably, outer projections 184 and inner projections 186 are formed on respective opposite surfaces of the upper and lower plates 164, 166 to fixedly support the filter element 168 therebetween. The outer projections 184 extend along the outermost edges of the plates 164, 166, and the inner projections 186 extend generally parallel to the outer projections 184 at a distance slightly larger than the thickness of the filter element 168.

The filter assembly 162 in turn is also fixedly supported by the lower and upper chamber members 130, 128. The lower chamber member 130 has a projection 190 extending toward the upper chamber member 128 and around the inlet opening 144. This projection 190 prevents the filter assembly 162 from slipping off the opening 144.

In addition, the upper chamber member 128 preferably has a plurality of ribs (not shown) extending toward the lower chamber member 130, parallel to each other. Tip portions of the respective ribs abut on an upper surface of the upper plate 164. Because a distance between the tip portions of the ribs and the lower chamber plate 130 is slightly less than a distance between the upper surface of the upper plate 164 and a lower surface of the lower plate 166, the filter assembly 162 can be securely interposed between the upper and lower chamber members 128, 130 when the upper chamber member 164 is affixed to the lower chamber member 130 by the coupling members 140.

A plurality of seal members 194 preferably are positioned at outer periphery portions of the upper and lower plates 164, 166 so as to be interposed between the respective chamber members 128, 130 and the respective plates 164, 166. Thereby, the members 128, 130, can be sealedly engaged with each other. However, any known technique can be used to form a sealed engagement between the members 128, 130, such as, for example, but without limitation, gaskets, o-rings, tongue and groove joints, adhesives and the like. Thus, air is allowed to enter the plenum chamber 124 only through the air inlet ports 160.

With reference to FIG. 4, the upper chamber member 128 preferably is fixed to the lower chamber member 130 by a pair of bolts 198 which extend through bolt holes (not shown) of the upper chamber member 128 and bolt holes (not shown) of the lower chamber member 130. This additional fixing is advantageous not only for the rigid coupling of these chamber members 128, 130 but also for inhibiting noise from occurring by vibration of the upper chamber member 128.

Because the air inlet ports 160 are formed at the bottom of the intake box 122, water and/or other foreign substances are unlikely to enter the plenum chamber 124. Additionally, the filter element 168 further prevents water and foreign particles from entering the throttle bodies 148. In addition, the pair of inlet ports 160 are defined by the ducts 170 extending into the plenum chamber 124. Thus, a desirable length for efficient silencing of intake noise can be accommodated within the plenum chamber 128.

Additionally, the lower chamber member 130 of the intake box 122 may include a blow-by gas inlet port 200 next to one of the apertures 148 through which the throttle bodies 148 extend. The blow-by gas inlet port 200 may be connected to the crankcase chamber 102 (FIG. 10) to permit blow-by gases (i.e., gases which may pass from the combustion chambers 98, past the pistons 92, and into the crankcase chamber 102 due to the extremely high pressures generated during combustion) to be reintroduced to the air intake system. The inlet port 200 may also be connected to other portions of the engine 32, such as the lubrication system, as is described in detail below.

A water discharge hole 202 preferably is provided in close proximity to the inlet port 200 to discharge water accumulating in the plenum chamber 124. The water discharge hole 202 can have a one-way valve (i.e., check valve) that allows the accumulating water to move out but inhibits water existing outside from entering.

The engine 32 also includes a fuel supply system configured to supply fuel for combustion in the combustion chambers 98. The fuel supply system includes the fuel tank 66 (FIG. 1) and fuel injectors 210 that are affixed to a fuel rail (not shown) which are mounted on the throttle bodies 148. The fuel rail extends generally horizontally in the longitudinal direction. A fuel inlet port (not shown) is defined at a forward portion of the lower chamber member 130 so that the fuel rail 212 is coupled with an external fuel passage.

Because the throttle bodies 148 are disposed within the plenum chamber 124, the fuel injectors 210 are also desirably positioned within the plenum chamber 124. However, other types of fuel injector can be used which are not mounted in the intake box 124, such as, for example, but without limitation, direct fuel injectors and induction passage fuel injectors connected to the scavenge passages of two-cycle engines.

Electrical cables for the fuel injectors 210 enter the intake box 122 through the through-hole 172 with the control cable of the throttle shaft 156. Each fuel injector 210 has an injection nozzle directed toward the intake port 116 associated with each fuel injector 210.

The fuel supply system also includes a low-pressure fuel pump (not shown), a vapor separator (not shown), a high-pressure fuel pump (not shown) and a pressure regulator (not shown), in addition to the fuel tank 66, the fuel injectors 210 and the fuel rail. Fuel supplied from the fuel tank 66 is pressurized by the low pressure fuel pump and is delivered to the vapor separator in which the fuel is separated from fuel vapors. One or more high pressure fuel pumps draw the fuel from the vapor separator and pressurize the fuel before it is delivered to the fuel rail. The pressure regulator controls the pressure of the supplied fuel, i.e., limits the fuel pressure to a preset pressure level. The fuel rail can be configured to support the fuel injectors 210 as well as deliver the fuel to the respective fuel injectors 210.

The fuel injectors 210 spray the fuel into the intake ports 116 at an injection timing and duration under control of an ECU (Electronic Control Unit) (not shown). The ECU can control the injection timing and duration according to any known control strategy which preferably refers to a signal from at least one engine sensor, such as, for example, but without limitation, the throttle valve position sensor.

The sprayed fuel is delivered to the combustion chambers 98 with the air when the intake ports 116 are opened to the combustion chambers 98 by the intake valves 118. The air and the fuel are mixed together to form air/fuel charges which are then combusted in the combustion chambers 98.

Figure 8:
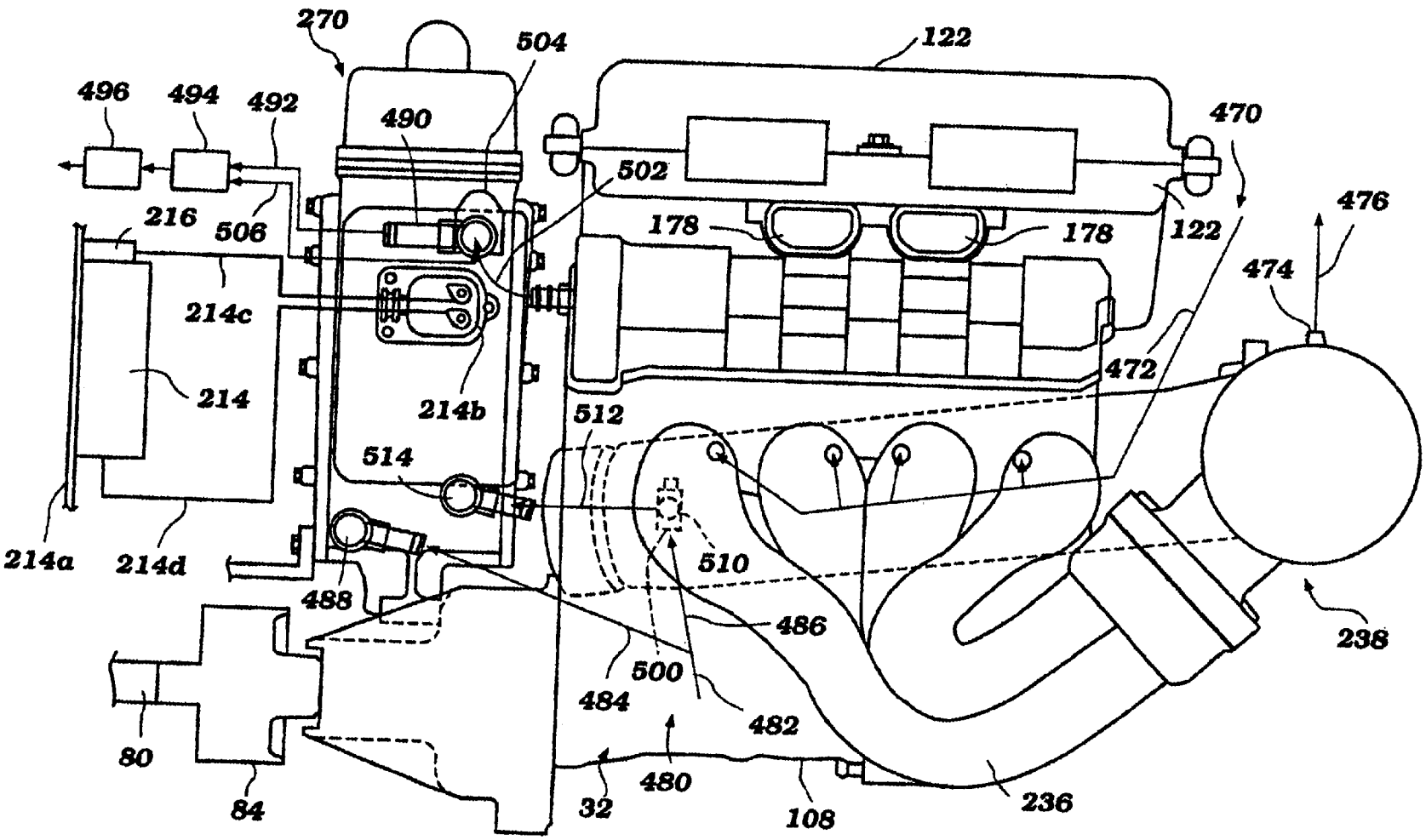
FIG. 8 is a starboard side elevational view of the engine showing a cooling system of the watercraft. Portions of the cooling system are illustrated schematically.

With reference to FIG. 8, the ECU may be housed within a electrical component box 214, along with other electrical components of the engine 32. The box 214 may be attached to a portion of the watercraft 30, such as an internal wall, or bulkhead 214*a*. Components within the box 214 may be in electric communication with a connector 214*b*, through connections 214*c*, 214*d*. Sensors of the engine 32 may be connected to connector 214*b* to communicate with components within the box 214. Preferably, a rectifier 216 is position within the connection 214*c*, between the components within the box 214 and the connector 214*b*.

The engine 32 further includes a firing or ignition system. In the illustrated engine 32, four spark plugs (not shown) are affixed to the cylinder head member 96 so that electrodes, which are defined at one ends of the plugs, are exposed to the respective combustion chambers 98. Plug caps are detachably coupled with the other ends of the spark plugs and have electrical connection with the plugs. Electric power is supplied to the plugs through power cables and the plug caps. The spark plugs are fired at an ignition timing under control of the ECU. The air/fuel charge is combusted during every combustion stroke accordingly.

With reference to FIGS. 3–5, the engine 32 further includes an exhaust system 224 to guide burnt charges, i.e., exhaust gases, from the combustion chambers 98. In the illustrated embodiment, with reference to FIG. 3, the exhaust system 224 includes four exhaust ports 226 (one shown). The exhaust ports 226 are defined in the cylinder head member 96 and communicate with the associated combustion chambers 98. Exhaust valves 228 are provided to selectively connect and disconnect the exhaust ports 226 with the combustion chambers 98. That is, the exhaust valves 228 selectively open and close the exhaust ports 226.

As illustrated in FIGS. 4 and 5, the exhaust system includes an exhaust manifold 231. In a presently preferred embodiment, the manifold 231 comprises a first exhaust manifold and a second exhaust manifold coupled with the exhaust ports 226 on the starboard side to receive exhaust gases from the respective ports 226. The first exhaust manifold is connected with two of the exhaust ports 226 and the second exhaust manifold is connected with the other two exhaust ports 226. In a presently preferred embodiment, the first and second exhaust manifolds are configured to nest with each other.

A downstream end of the exhaust manifold 231 is coupled with a first unitary exhaust conduit 236. The first unitary conduit 236 is further coupled with a second unitary exhaust conduit 238. The second unitary conduit 238 is then coupled with an exhaust pipe 240 on the rear side of the engine body 108.

The exhaust pipe 240 extends rearwardly along a side surface of the engine body 108 on the port side. The exhaust pipe 240 is then connected to a water-lock 242 at a forward surface of the water-lock 242. With reference to FIG. 2, a discharge pipe 244 extends from a top surface of the water-lock 242 and transversely across the center plane CP. The discharge pipe 244 then extends rearwardly and opens at a stem of the lower hull section 36 in a submerged position. The water-lock 242 inhibits the water in the discharge pipe 244 from entering the exhaust pipe 240.

The engine 32 further includes a cooling system configured to circulate coolant into thermal communication with at least one component within the watercraft 30. Preferably, the cooling system is an open type cooling system, circulating water from the body of water in which the watercraft 30 is operating, into thermal communication with heat generating components within the watercraft 30. However, other types of cooling systems can be used, such as, for example, but without limitation, closed-type liquid cooling systems using lubricated coolants and air-cooling types.

The cooling system includes a water pump arranged to introduce water from the body of water surrounding the watercraft 30, and a plurality of water jackets defined, for example, in the cylinder block 90 and the cylinder head member 96. The jet propulsion unit preferably is used as the water pump with a portion of the water pressurized by the impeller being drawn off for the cooling system, as known in the art. Although the water is primarily used for cooling these engine portions, part of the water is used also for cooling the exhaust system 224. That is, the engine 32 has at least an engine cooling system and an exhaust cooling system. The water directed to the exhaust cooling system preferably passes through a separate passage apart from the passage connected to the engine cooling system. The exhaust components 231, 236, 238 and 240 are formed as dual passage structures in general. More specifically, a water jacket 248 is defined around respective exhaust passages wherein cooling water is circulated, thereby cooling the exhaust system 224.

With reference to FIGS. 3 and 4, the engine 32 preferably includes a secondary air supply system 250 that supplies air from the air induction system to the exhaust system 224. More specifically, for example, hydro carbon (HC) and carbon monoxide (CO) components of the exhaust gases can be removed by an oxidation reaction with oxygen ($O_2$) that is supplied to the exhaust system 224 from the air induction system.

A secondary air supply device 252 is disposed next to the cylinder head member 96 on the starboard side. The air supply device 252 defines a closed cavity and contains a control valve therein. The air supply device 252 is affixed to the engine body 108, preferably together with one of the stays 132 that supports the air intake box 122. A single upstream air conduit extends from the lower chamber member 130 to a lower portion of the air supply device 252, and four downstream air conduits extend from the air supply device 252 to the exhaust manifold 231. That is, the respective downstream conduits are allotted to respective passages of the manifold 231. In addition, a vacuum line extends from a top portion of the air supply device 252 to one of the air intake ports 116.

The control valve controls a flow of air from the upstream conduit toward the downstream conduits in accordance with a condition of the negative pressure. If the negative pressure is greater than a predetermined negative pressure, the control valve permits the air flow to the downstream conduits. However, if the negative pressure is less than the predetermined negative pressure, then the control valve precludes the air from flowing to the downstream conduits. Air supplied from the air supply device 252 thus allows air to pass to the exhaust system preferably under a relatively high speed and/or high load condition because greater amounts of hydrocarbon (HC) and carbon monoxide (CO) are more likely to be present in the exhaust gases under such a condition.

Figure 6:
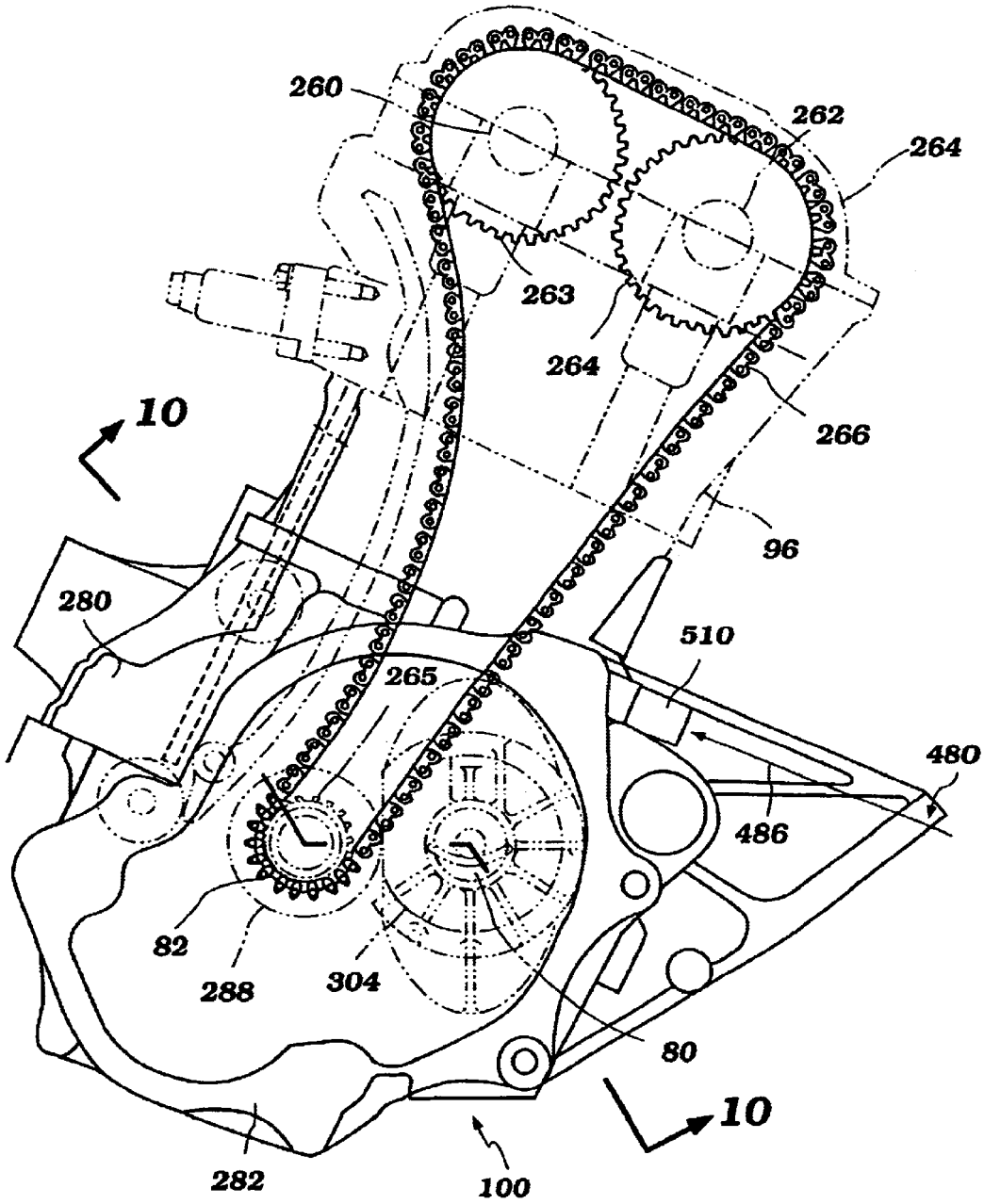
FIG. 6 is a rear elevational view of the engine showing portions of a valve drivetrain assembly.

With reference to FIGS. 3 and 6, the engine 32 has a valve cam mechanism for actuating the intake and exhaust valves 118, 228. In the illustrated embodiment, a double overhead camshaft drive is employed. That is, an intake camshaft 260 actuates the intake valves 118 and an exhaust camshaft 262 separately actuates the exhaust valves 228. The intake camshaft 260 extends generally horizontally over the intake valves 118 from fore to aft in parallel to the center plane CP, and the exhaust camshaft 262 extends generally horizontally over the exhaust valves 228 from fore to aft also in parallel to the center plane CP.

Both the intake and exhaust camshafts 260, 262 are journaled by the cylinder head member 96 with a plurality of camshaft caps. The camshaft caps holding the camshafts 260, 262 are affixed to the cylinder head member 96. A cylinder head cover member 264 extends over the camshafts 260, 262 and the camshaft caps, and is affixed to the cylinder head member 96 to define a camshaft chamber.

The intake camshaft 260 has cam lobes each associated with a respective intake valve 118, and the exhaust camshaft 262 also has cam lobes associated with a respective exhaust valve 228. The intake and exhaust valves 118, 228 normally close the intake and exhaust ports 116, 226 by a biasing force of springs. When the intake and exhaust camshafts 260, 262 rotate, the cam lobes push the respective valves 118, 228 to open the respective ports 116, 228 by overcoming the biasing force of the spring. The air thus can enter the combustion chambers 98 when the intake valves 118 open. Similarly, the exhaust gases can move out from the combustion chambers 98 when the exhaust valves 228 open.

The crankshaft 82 preferably drives the intake and exhaust camshafts 260, 262. With reference to FIG. 6, the respective camshafts 260, 262 have driven sprockets 263, 264, respectively, affixed to ends thereof. The crankshaft 82 also has a drive sprocket 265. Each driven sprocket, 263, 264 has a diameter which is twice as large as a diameter of the drive sprocket 265. A timing chain 266 or belt is wound around the drive sprocket 265 and driven sprockets 263, 264. When the crankshaft 82 rotates, the drive sprocket 265 drives the driven sprockets 263, 264 via the timing chain 266, and thus the intake and exhaust camshafts 260, 262 also rotate. The rotational speed of the camshafts 260, 262 are reduced to half the rotational speed of the crankshaft 82 because of the differences in diameters of the drive sprocket 265 and driven sprockets 263, 264.

In operation, ambient air enters the internal cavity 40 defined in the hull 34 through the air ducts 70. The air is then introduced into the plenum chamber 124 defined by the intake box 122 through the air inlet ports 160 and drawn into the throttle bodies 148. The air filter element 168, which preferably comprises a water-repellent element and an oil resistant element, filters the air. The majority of the air in the plenum chamber 124 is supplied to the combustion chambers 98. The throttle valves 154 in the throttle bodies 148 regulate an amount of the air permitted to pass to the combustion chambers 98. The opening angles of the throttle valves 154 are controlled by the rider with the throttle lever 58 and thus controls the airflow across the valves. The air hence flows into the combustion chambers 98 when the intake valves 118 open. At the same time, the fuel injectors 210 spray fuel into the intake ports 116 under the control of ECU. Air/fuel charges are thus formed and delivered to the combustion chambers 98.

The air/fuel charges are fired by the spark plugs under the control of the ECU. The burnt charges, i.e., exhaust gases, are discharged to the body of water surrounding the watercraft 30 through the exhaust system 224. A relatively small amount of the air in the plenum chamber 124 is supplied to the exhaust system 224 through the secondary air supply system 250 so as to aid in further combustion of any unburned fuel remaining in the exhaust gases.

The combustion of the air/fuel charges causes the pistons 94 to reciprocate and thus causes the crankshaft 82 to rotate. The crankshaft 82 drives the impeller shaft 80 and the impeller rotates in the hull tunnel 74. Water is thus drawn into the tunnel 74 through the inlet port 76 and then is discharged rearward through the steering nozzle 86. The rider steers the nozzle 86 by the steering handle bar 56. The watercraft 30 thus moves as the rider desires.

The engine 32 preferably includes a lubrication system that delivers lubricant oil to engine portions for inhibiting frictional wear of such portions. In the illustrated embodiment, a dry-sump lubrication system is employed. This system is a closed-loop type and includes an oil reservoir 270 as illustrated, for example, in FIGS. 2, 4 and 5 and described below in greater detail with reference to FIGS. 10–14.

An oil delivery pump is provided within a circulation loop to deliver the oil in the reservoir 270 to the engine portions that are to be lubricated, for example, but without limitation, the pistons 94 and crankshaft bearings 106. The delivery pump preferably is driven by the crankshaft 82, as described below, but may alternatively be driven by one of the camshafts 260, 262.

Figure 10:
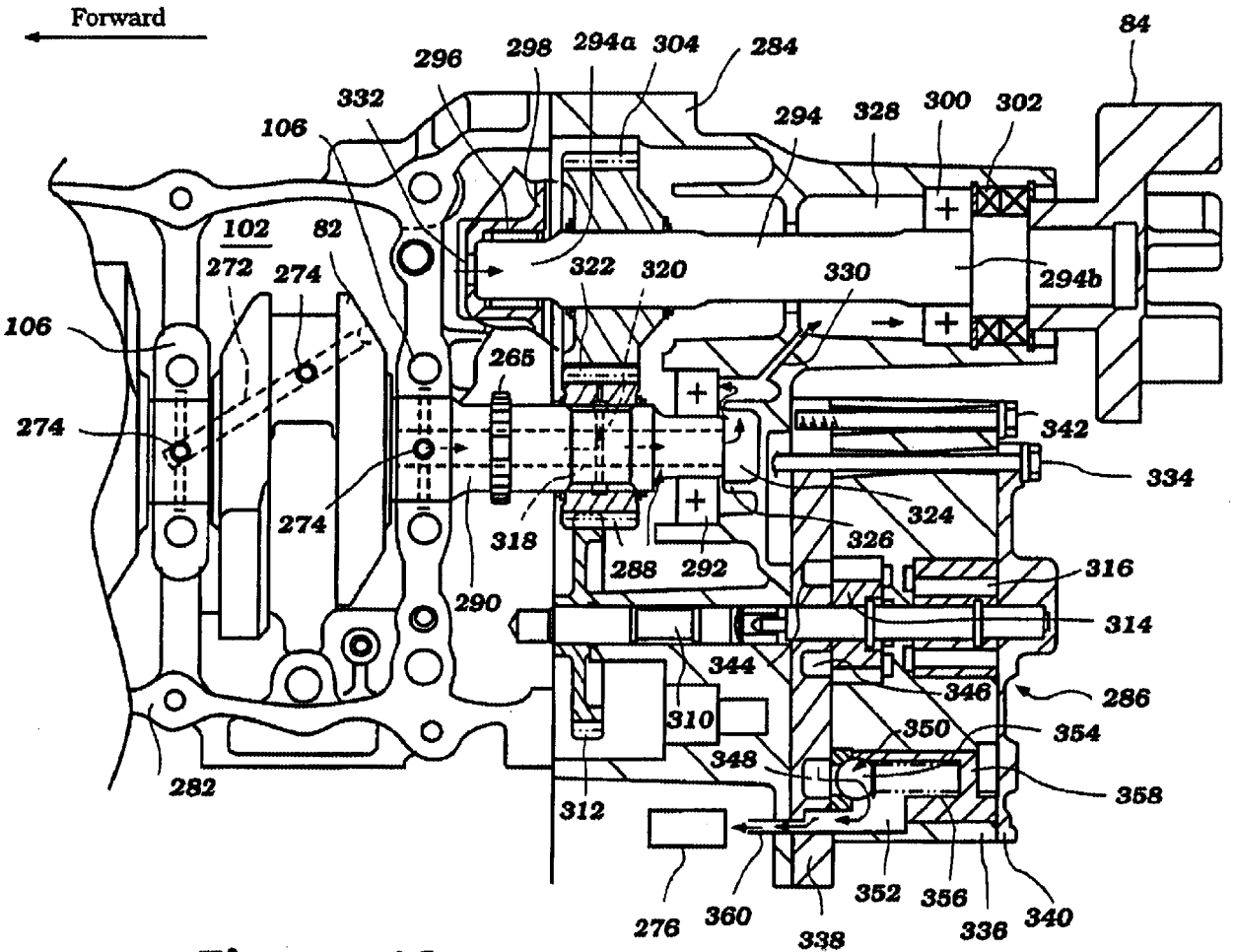
FIG. 10 is a top plan view of a lower crankcase member of the engine and a cross-sectional view of an output shaft and oil pump assembly taken along the line 10—10 of FIG. 6.

With reference to FIG. 10, oil galleries 272 are defined in the crankcase member 100, crankshaft bearings 106 and the crankshaft 82 itself. The oil galleries 272 include a plurality of openings 274 which are generally aligned with portions of the engine 32 where lubrication is desirable. The oil is pressurized by the delivery pump to flow through these galleries 272. Before entering the galleries 272, the oil passes through an oil filter 276 (shown in phantom in FIG. 5) which removes foreign substances from the oil. The oil filter 276 is preferably disposed at a side surface of the engine body 108 on the port side.

The oil comes out and/or is sprayed to the portions from the openings 274 of the galleries 272. A return pump is also provided in the system to return the oil that has moved down to an inner bottom portion of the crankcase member 100 back to the oil reservoir 270. The return pump preferably is driven by the crankshaft 82. However, the return pump may alternatively be driven by one of the camshafts 260, 262 also.

With reference to FIGS. 6 through 30, a presently preferred lubrication system is described in detail. As mentioned above, an oil pump is provided to deliver oil to portions of the engine 32 where lubrication is desired. With primary reference to FIG. 10, a presently preferred oil pump and associated engine components are described in detail.

With reference to FIG. 6, the crankcase member 100 is desirably comprised of an upper crankcase member 280 and a lower crankcase member 282. The crankcase members 280, 282 are coupled together to define the crankcase chamber 102, as described above. With reference to FIG. 7, a drive shaft cover member 284 is coupled to a rearward end of the crankcase 100 and encloses the coupling arrangement 84 (FIG. 1) between the crankshaft 82 and the impeller shaft 80.

FIG. 10 shows a top plan view of the lower crankcase member 282 and illustrates the drive shaft cover 284 and a preferred oil pump arrangement 286 in section. As described above, a coupling member 84 rotatably couples the crankshaft 82 with the impeller shaft 80. In the illustrated embodiment, the impeller shaft 80 is offset laterally from the crankshaft 82 and torque is transferred therebetween by a output shaft 294.

Specifically, a drive gear 288 is coupled for rotation with a rearward end portion, or driveshaft 290, of the crankshaft 82. A rearward end of the drive shaft 290 is supported by the drive shaft cover 284 through a bearing 292.

The output shaft 294 is laterally offset and parallel to the crankshaft 82. A forward end 294A of the output shaft 294 is rotatably supported by the crankcase 100 through a bearing 296. Specifically, a separate support housing, or sleeve 298, is fixedly supported by the crankcase 100. The support sleeve 298 includes a cavity which receives the forward end 294A of the output shaft 294. The bearing 296 is interposed between the support sleeve 298 and the forward end 294A of the output shaft 294. A rearward end 294B of the output shaft 294 is rotatably supported by the drive shaft cover 284 through a bearing 300. A seal assembly 302 is positioned rearward of the bearing 300 and operates to inhibit water from entering the crankcase 100 between the output shaft 294 and the drive shaft cover 284.

A driven gear 304 is coupled for rotation with the output shaft 294 and is driven by the drive gear 288 of the drive shaft 290. Thus, the output shaft 294 is driven by the crankshaft 82 of the engine 32. As described above, the coupling member 84 is fixed to rearward end of the output shaft 294 and couples the output shaft 294, and thus the crankshaft 82, to the impeller shaft 80 to drive the impeller and propel the watercraft 30. Preferably, the diameter of the drive gear 288 is smaller than the diameter of the driven gear 304. As such, the drive gear 288 and the driven gear 304 define a gear reduction pair, thereby driving the output shaft 294 at a lower angular velocity than the crankshaft 82. Thus, the engine 32 can be configured to operate at speeds higher than the maximum design speed of the impeller, i.e., the speed at which the impeller cavitates.

An oil pump drive shaft 310 is rotatably supported by the drive shaft cover 284 and is laterally offset and parallel to the crankshaft 82. A forward end of the oil pump drive shaft 310 includes a driven gear 312, which is coupled with the drive gear 288 of the drive shaft 290. A rearward end of the oil pump drive shaft 310 extends into the oil pump 286 and is coupled to both a delivery pump 314 and a return pump 316. Thus, the delivery pump 314 and the return pump 316 are driven by the crankshaft 82 of the engine 32 through the oil pump drive shaft 310.

As described above, the oil pump 286 is configured to deliver lubrication oil to various portions of the engine 32, including the galleries 272 of the crankshaft 82. Oil is also delivered by the oil pump 286 to a central oil passage 318 within the drive shaft 290. A transverse oil passage 320 connects the oil passage 318 to an oil passage 322, which passes radially through the drive gear 288. Advantageously, a portion of the lubricating oil passing through a passage 318 is diverted into the transverse passage 320 and is delivered to the mating portions of the drive gear 288 and driven gear 304 through the oil passage 322. Thus, the mating surfaces of the gears 288, 304 are desirably lubricated to inhibit wear.

A rearward end of the oil passage 318 opens into an oil collection pocket 324 defined by the drive shaft cover 284. A peripheral wall 326 of the oil collection pocket extends toward and is spaced from the bearing 292 to permit oil to pass from the pocket 324 and lubricate the bearing 292. Advantageously, the wall 326 tends to direct lubricating oil toward the bearing 292, as indicated by the arrow in FIG. 10.

Oil passing between the wall 326 and the bearing 292 is also permitted to pass to another oil collection pocket 328 through a passage 330. The oil within the collection pocket 328 advantageously lubricates the bearing 300, which supports a rearward end of the output shaft 294. In addition, the support sleeve 298 which supports a forward end 294A of the output shaft 294 includes an aperture 332 passing axially therethrough. The aperture 332 permits oil within the crankcase chamber 102 to lubricate the bearing 296 as indicated by the arrow passing through aperture 332. The oil supplied to the aperture 332 may also be flung from the timing chain 266 (FIG. 6) that is driven by the drive sprocket 265. The timing chain 266 tends to collect oil as it passes thorough a lower portion of the crankcase chamber 102 and, advantageously, may fling it in a direction of the aperture 332 due to the high velocity with which the timing chain 266 is moving.

With reference to FIGS. 10 through 14, the oil pump 286 is coupled to a rearward end of the crankcase 100 and, specifically, to a rearward end of the drive shaft cover 284 by plurality of fasteners, such as bolts 334 (one shown). The oil pump 286 is generally comprised of the pump body 336, a forward pump plate 338, and a rearward pump plate 340. The forward plate 338 is positioned adjacent the drive shaft cover 284 and the pump body 336 is positioned between the forward plate 338 and the rearward plate 340. The pump body 336 is secured to the forward plate 338 by one or more fasteners, such as bolts 342 (one shown). The rearward plate 340 is secured to the pump body 336 by one or more fasteners, such as the bolt 334, which in the illustrated embodiment also secures the oil pump assembly 286 to the drive shaft cover 284.

Figure 11:
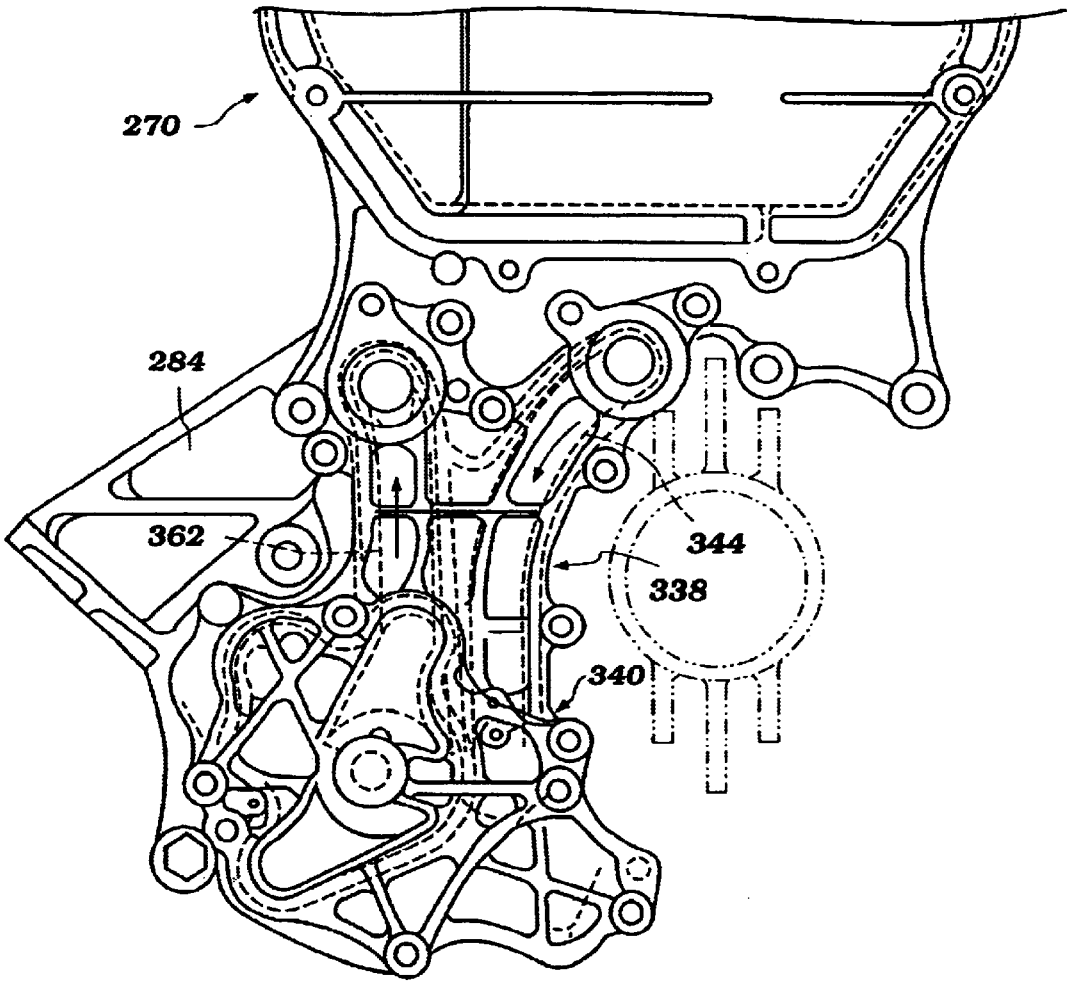
FIG. 11 is an enlarged rear elevational view of the oil pump assembly.

Both the delivery pump 314 and the return pump 316 are housed for rotation within the pump body 336. Each of the pumps 314, 316 are configured to pressurize a fluid on a downstream side of the pump 314, 316. The delivery pump 314 receives oil from within the oil reservoir 270 through delivery channel 344, as illustrated in FIG. 11. The oil is pressurized by the delivery pump 314 and the pressurized oil enters a downstream opening 346 which communicates with a downstream passage 348.

A check valve arrangement 350 permits selective communication between passage 348 and a passage 352, which is downstream from the check valve 350. The check valve 350 closes when the lubrication oil pressure is below a predetermined threshold, such as when the engine is turned off, to prevent oil from the reservoir 270 from completely draining into the crankcase 100. In addition, the check valve 350 substantially prevents oil from flowing in a reverse direction from the crankcase 100 into the oil pump 286.

The check valve 350 generally comprises a valve body, or ball 354, biased into engagement with a valve seat by a biasing member, such as spring 356. Desirably, the check valve 350 is disposed within a housing member 358 that is a separate member from the pump body 336. Preferably, the housing member 358 is made from a wear resistant material, such as iron, to inhibit wear caused by movement of the valve ball 354 and/or spring 356.

The downstream passage 352 communicates with an external oil passage 360 which delivers oil to the oil filter 376, as described above. Once the oil passes through the oil filter 376, it is delivered to various parts of the engine 32, such as oil galleries 272 within the crankshaft 82 and to the camshaft chamber defined within the cylinder head 96, for example.

Figure 12:
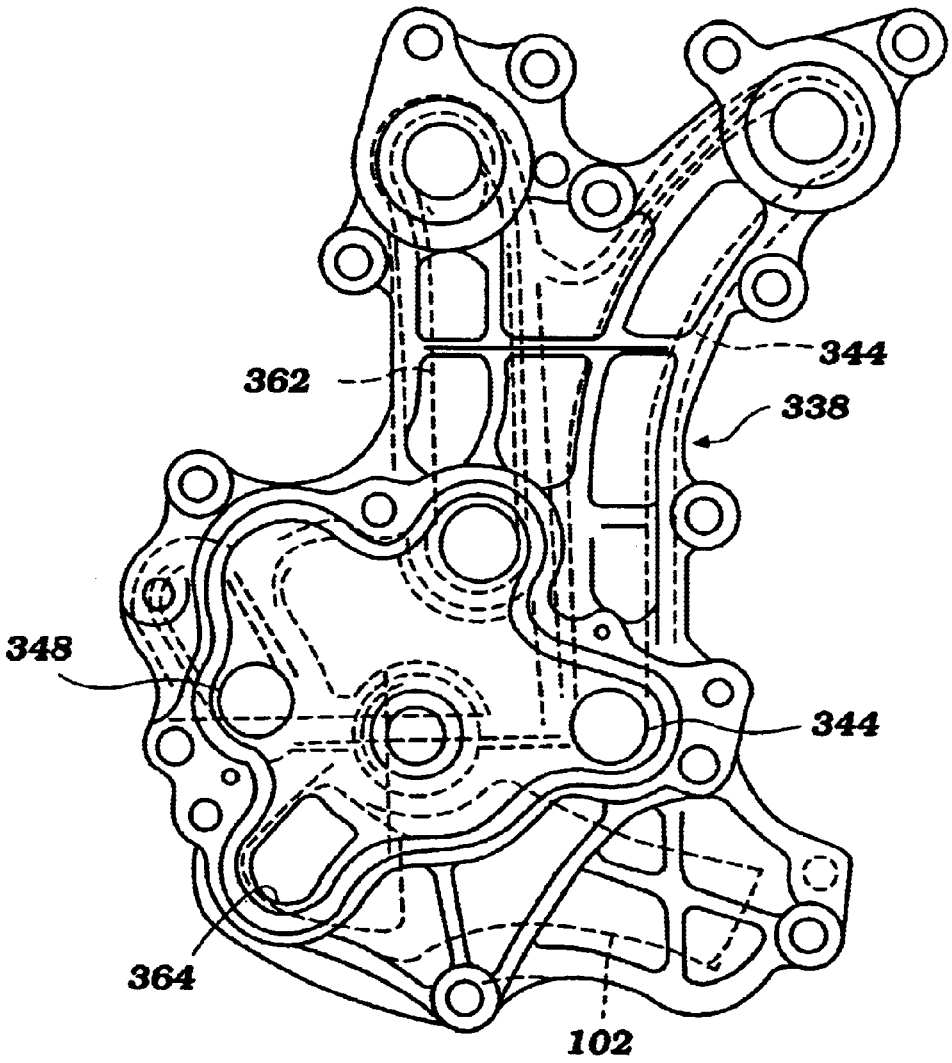
FIG. 12 is a rear elevational view of a front plate member of the oil pump assembly of FIG. 11.
Figure 13:
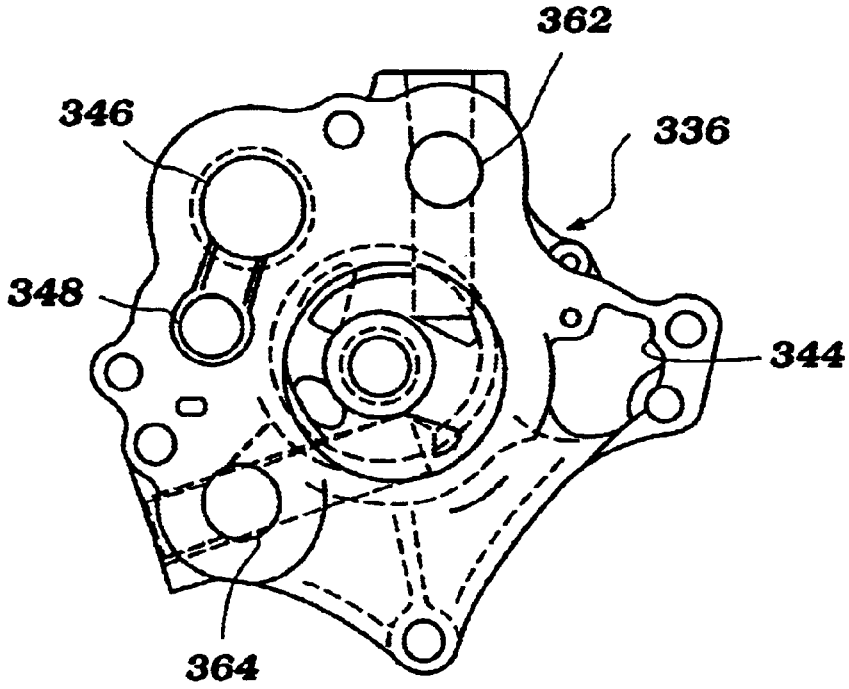
FIG. 13 is a rear view of a pump body of the oil pump assembly of FIG. 11.
Figure 14:
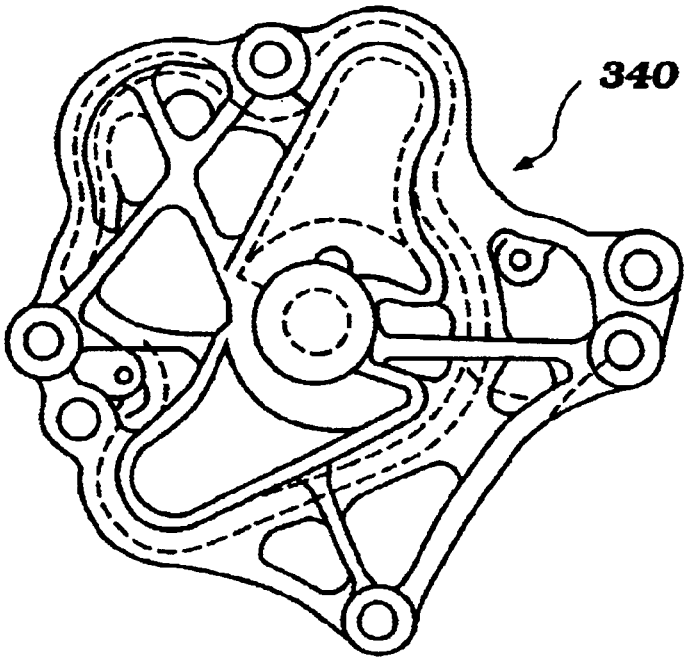
FIG. 14 is a rear view of a rear plate member of the oil pump assembly of FIG. 11.

An upstream side of the return pump 316 communicates with a lower portion of the crankcase chamber 102, as illustrated in FIG. 12. The return pump 316 receives oil from the crankcase chamber 102 and delivers it to the oil reservoir 270 through return passage 362, as shown in FIG. 11. With reference to FIGS. 12 and 13, specifically, a passage 364 connects the crankcase chamber 102 to an upstream side of the return pump 316. The oil is pressurized by the return pump 316 and is delivered to the return passage 362, whereby the oil is returned to the reservoir 270. Preferably, the return pump 316 is configured to have a greater pumping capacity (i.e., a higher flow rate) than the delivery pump 314 so that oil is returned to the reservoir at least as quickly as it is withdrawn by the delivery pump 314.

Figure 15:
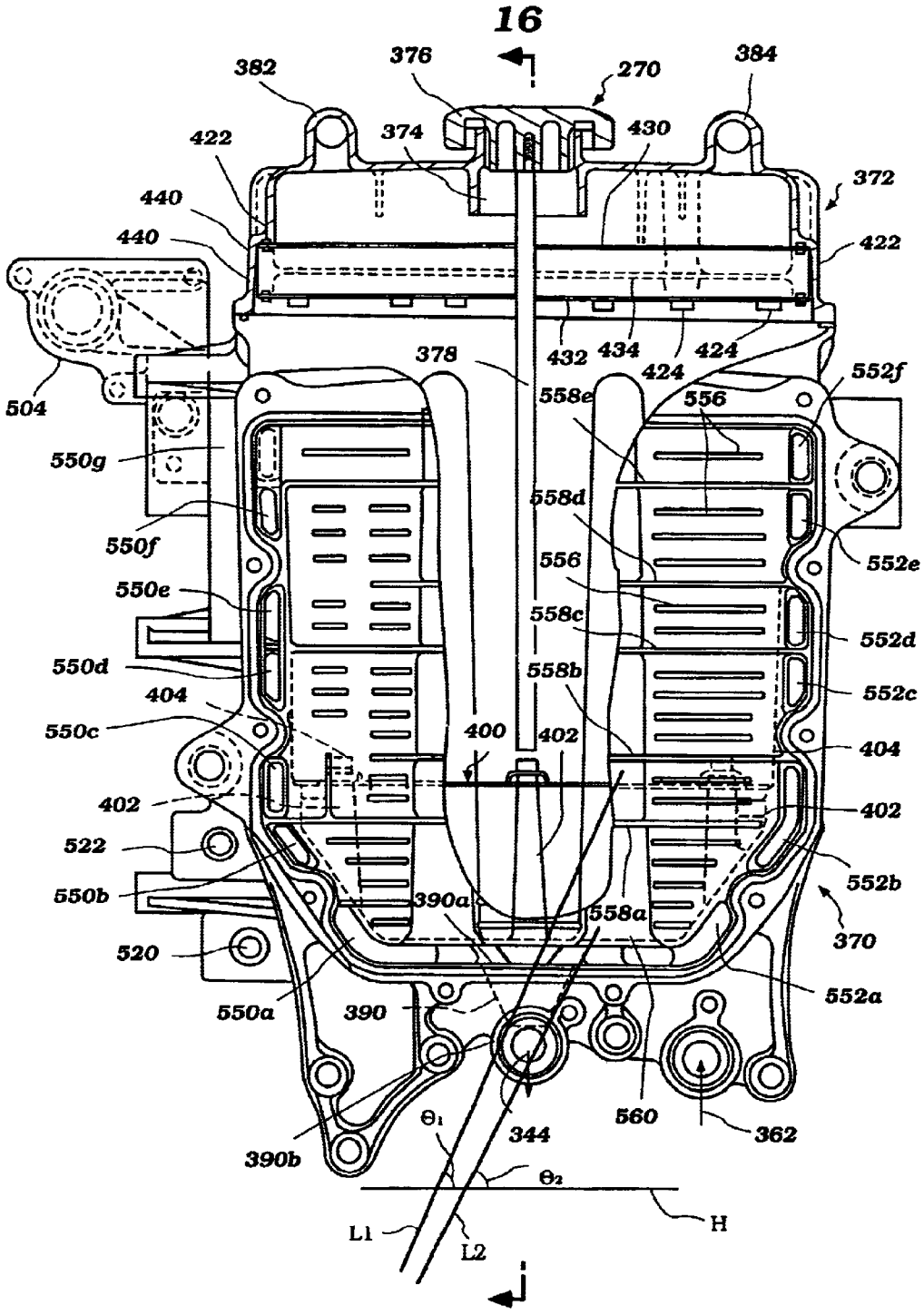
FIG. 15 is a partial cross-sectional and front elevational view of the reservoir of FIG. 7 showing an internal cavity of the reservoir and cooling ribs formed on a rear external surface of the reservoir.
Figure 16:
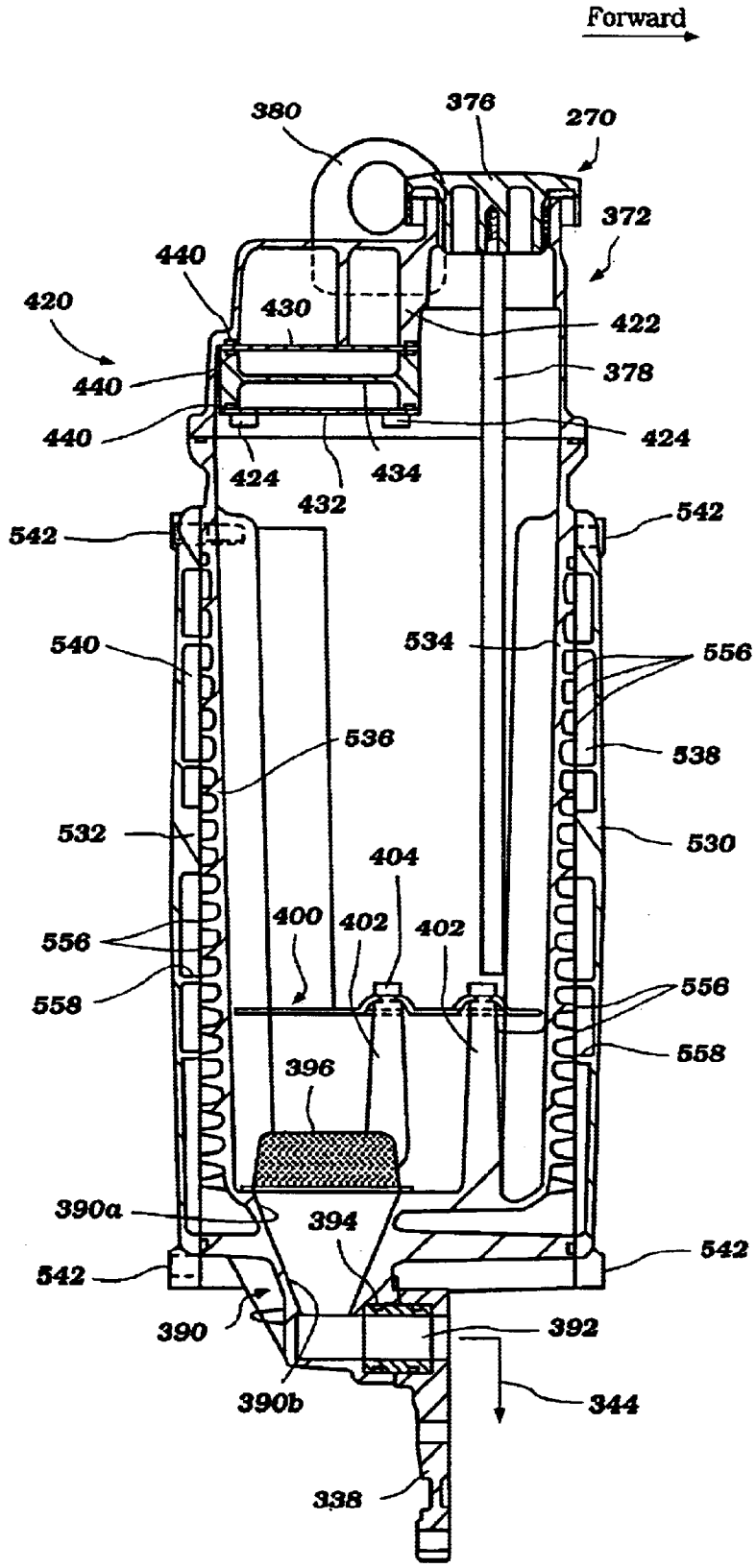
FIG. 16 is a cross-sectional view of the reservoir taken along line 16—16 of FIG. 15 showing front and rear plate members connected to front and rear external surfaces of the reservoir to define cooling water jackets therebetween. A baffle plate is shown in a lower portion of the reservoir, above an oil delivery port. A separate baffle arrangement is shown in an upper portion of the reservoir, separating a breather chamber from the main portion of the reservoir.
Figure 17:
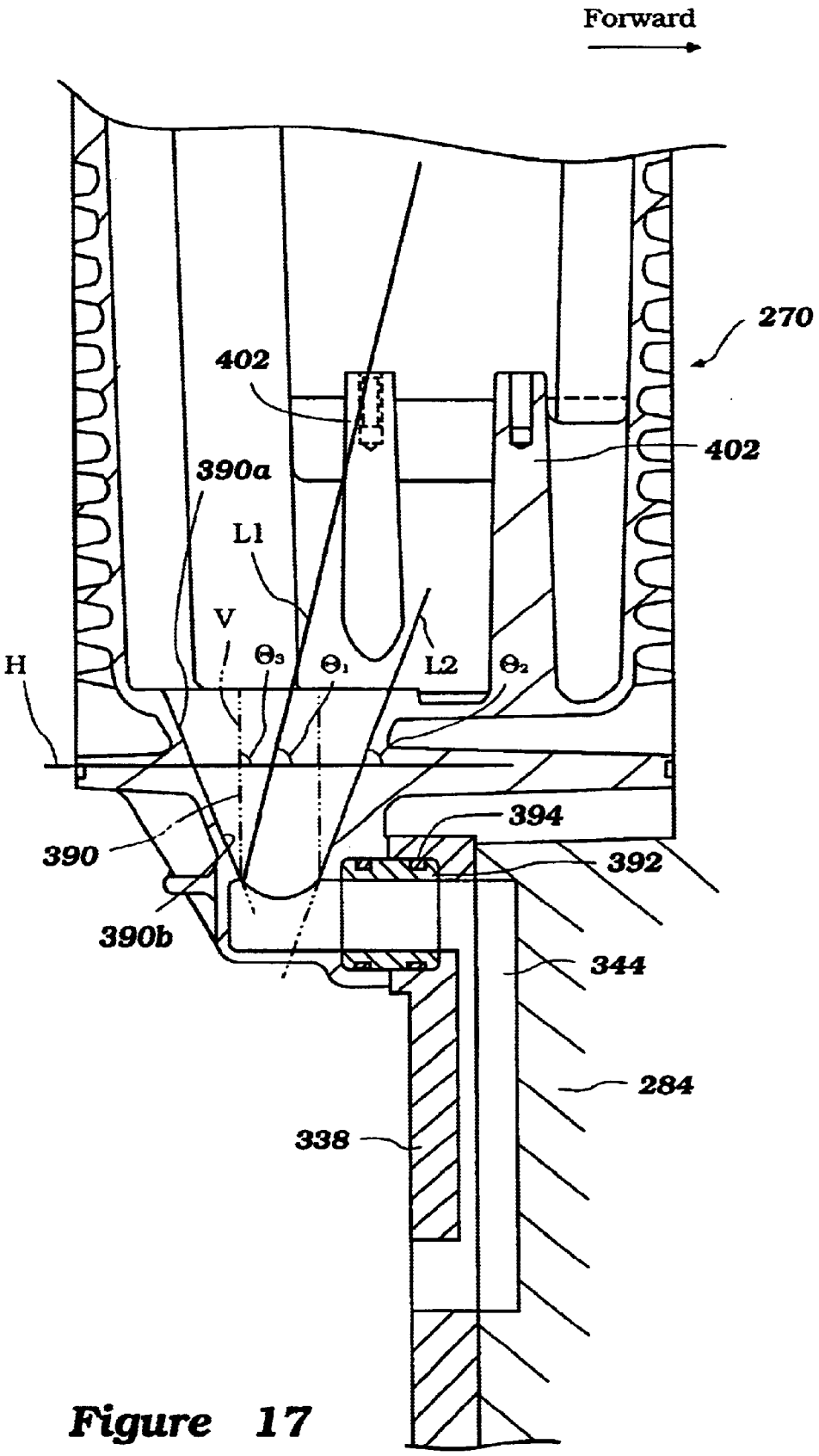
FIG. 17 is an enlarged sectional view of the oil delivery port of FIG. 16.

With reference to FIGS. 15 through 17, the reservoir 270 is comprised primarily of a reservoir body 370 extending upward from a closed end to an open end and defines a reservoir cavity therein. The open end of the reservoir 270 is closed by a lid 372, which is coupled to the upper end of the reservoir 270.

The lid 372 defines an opening 374 which permits fluid to be added to the reservoir 270. A cap 376 closes the opening 374 during normal operation of the watercraft 30. A fluid level indicator rod 378 may be coupled to the cap 376 and extend into the reservoir 270 to permit a user of the watercraft 30 to determine if the fluid level within the reservoir 270 is proper, as is conventional. With additional reference to FIG. 21, the lid 372 desirably includes a pair of mounting tabs 380 which permit the reservoir 270 to be mounted to a component of the watercraft 30, such as a portion of the engine 32 or the hull 34.

During operation of the engine 32, air and blow-by gases become entrained in the oil moving through the lubrication system. Because the oil pools within the reservoir 270, a significant amount of the entrained air and blow-by gases aspirate out of the oil. Thus, the lid 372 also includes a pair of breather ports 382, 384 to allow venting of the air and blow-by gases within the reservoir 270. The breather ports 382, 384 are described in greater detail below.

Figure 18:
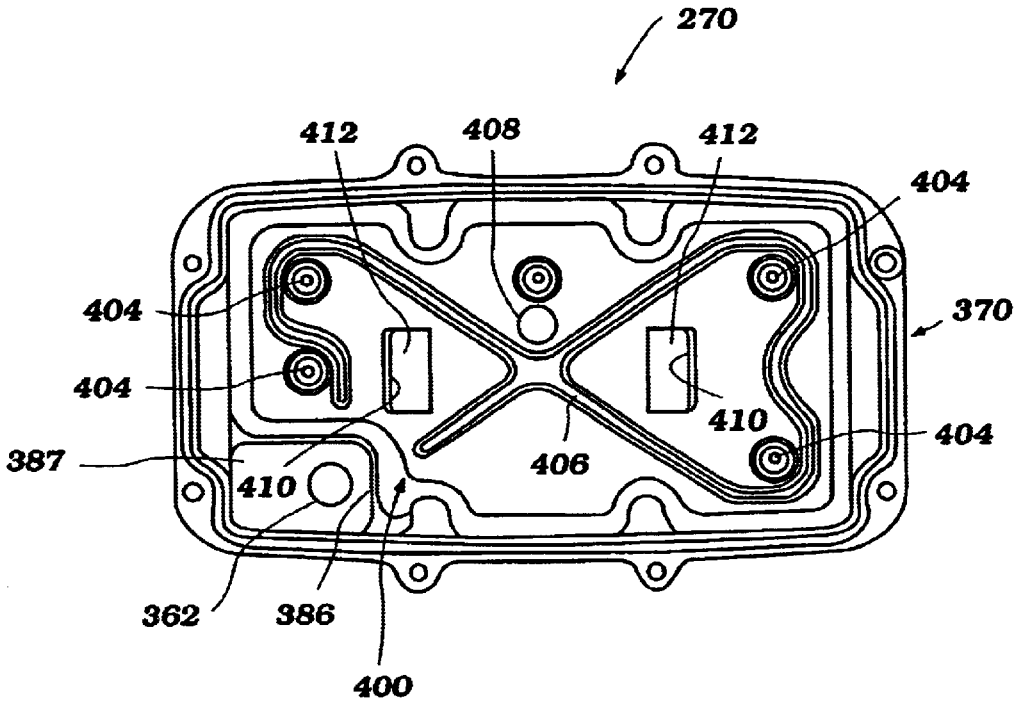
FIG. 18 is a top plan view of the reservoir of FIG. 15 and illustrating the lower baffle plate of FIG. 16.
Figure 19:
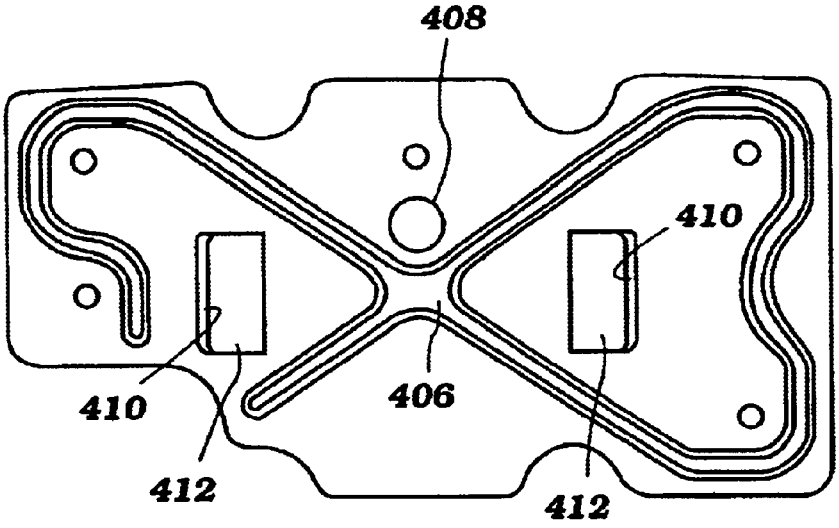
FIG. 19 is a top plan view of the lower baffle plate of FIG. 16, removed from the reservoir.
Figure 20:
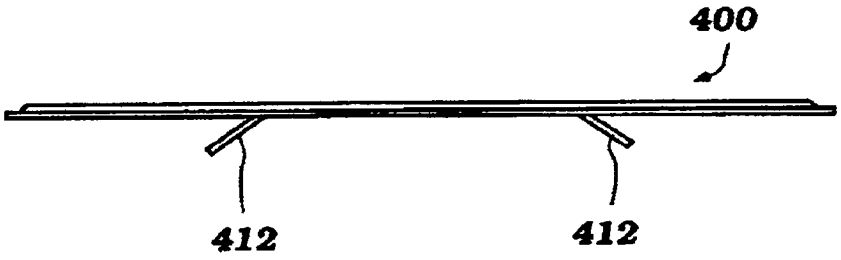
FIG. 20 is a side elevational view of the baffle plate of FIG. 19.
Figure 21:
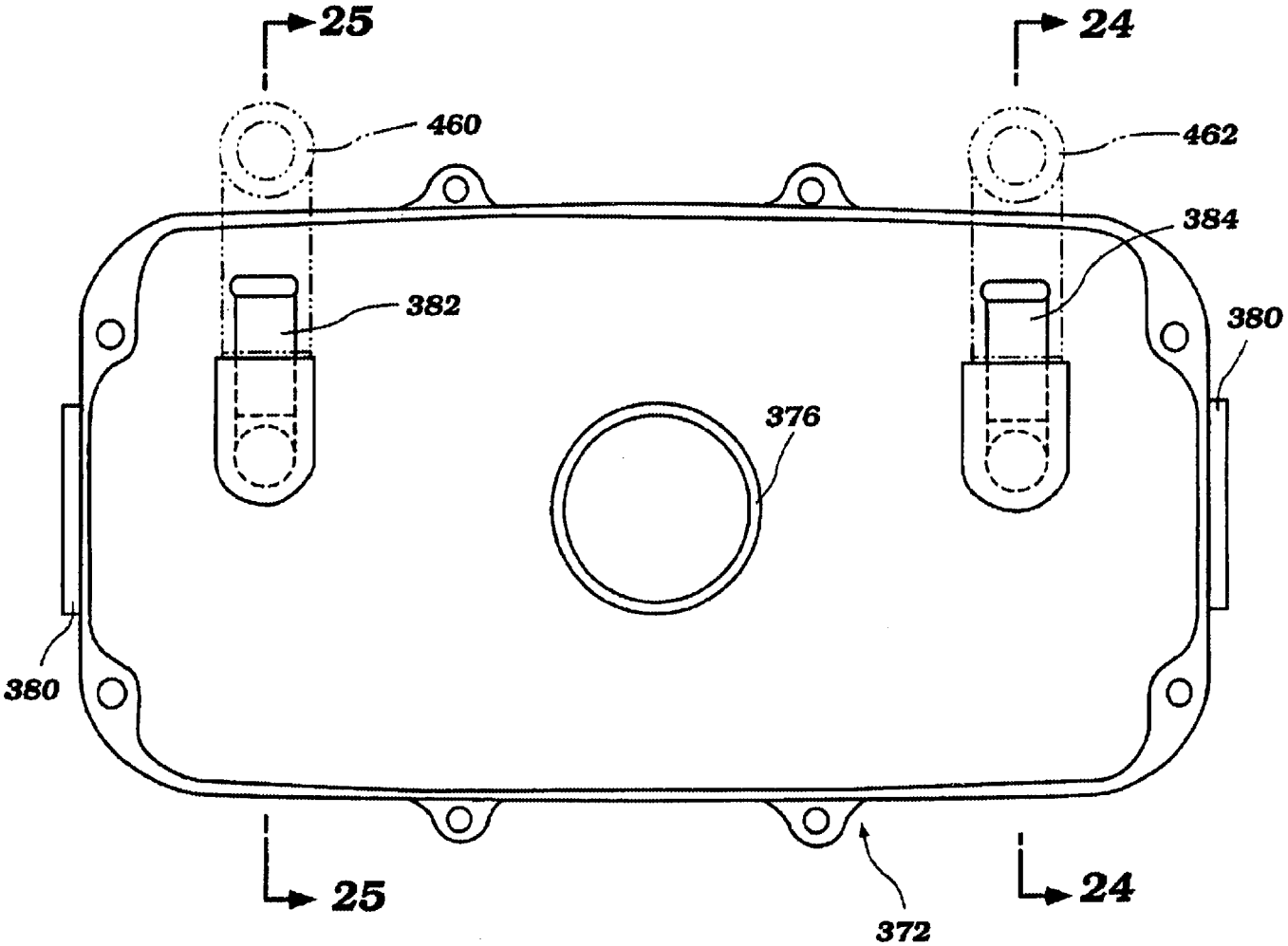
FIG. 21 is a top plan view of the reservoir showing a pair of breather ports extending from the lid of the reservoir.

As described above, oil within the reservoir 270 communicates with the oil pump 286 through the oil delivery passage 344 and the oil return passage 362. Desirably, the passages 344, 362 communicate with a lower end of the reservoir 270. With additional reference to FIGS. 28 and 29, a wall 386 desirably extends in an upward direction within the reservoir 270 between the return passage 362 and the supply passage 344. With reference to FIG. 18, the wall 386 is desirably connected to the port side and rear walls of the reservoir 270 to define a staging area 387 separated from the remaining interior, or main portion, of the reservoir 270. Advantageously, the staging area 387 is in communication with the return line 362 such that returning oil is held within the staging area 387 until it reaches a level sufficient to flow over the upper surface of the wall 386.

The wall 386 inhibits oil which has just returned to the reservoir 270 through return line 362 from being immediately supplied to the oil pump 286 through the supply line 344. Such a feature retains the oil within the reservoir 270 for a longer period of time, thereby permitting the oil to be cooled before being delivered to the oil pump 286 and, subsequently, the engine 32. Additionally, the oil within the staging area 387 is held in proximity to the outer walls of the reservoir 270 and in thermal communication with cooling water flowing within cooling jackets of the reservoir, as is described in detail below.

With reference to FIGS. 15 through 17, the oil delivery passage 344 communicates with the lower end of the reservoir 270, preferably in a central portion thereof. Oil moves from the reservoir 270 to the delivery channel 344 through an oil delivery port 390, which is desirably generally conical in shape and tapers in diameter from its upper, or inlet end 390A to its lower, or outlet end 390B.

An internal sleeve 392 extends across an interface within the supply channel 344 between the reservoir 270 and the forward pump plate 338. A pair of O-rings 394 are retained within a pair of grooves on each side of the transition to inhibit oil from leaking between the reservoir 270 and the forward pump plate 338.

With reference to FIG. 16, a filter member 396 desirably covers the delivery port 390 to filter oil moving from the reservoir 270 into the delivery port 390. Thus, the oil is filtered after returning from the engine 32 before being redelivered to the oil pump 286. The filter member 396 has been omitted in the other figures for the purpose of clarity.

With reference to FIG. 15, a line L1 is defined as a line that is generally parallel with the surface of the oil within the reservoir 270 when the watercraft 30 is making a hard right-hand turn at high speed. Desirably, the line L1 is generally co-linear with the oil surface. The line L1 defines an angle $\theta 1$ with a horizontal plane H. The angle $\theta 1$ generally corresponds with the angle of the sides of the hull bottom 36 from the horizontal plane H.

A line L2 is parallel to the lateral side surfaces of the delivery port 390 and defines an angle $\theta 2$ with the horizontal plane H. The angle θ2 is desirably smaller than the angle θ1. As a result, an ample supply of oil to the delivery channel 344 is insured, even when the watercraft 30 is leaning. Desirably, the angle θ2 is between about 30° and 80°. Preferably, the angle θ2 is between about 40° and 70°.

With reference to FIG. 17, desirably at least the forward most portion of the delivery port 390 is also tapered, or inclined, from the upper portion 390*a* toward the lower portion 390*b*. In FIG. 17, a line L1 represents a line parallel to the surface of the oil within the reservoir 270 when the watercraft 30 is pitched forwardly (i.e., due to sudden deceleration). The line L1 defines an angle θ1 with the horizontal plane H.

A line L2 is parallel with a forward surface of the delivery port 390, generally parallel with the longitudinal axis of the watercraft 30. The line L2 defines an angle θ2 with the horizontal plane H. The angle θ2 is again desirably less than the angle θ1, thereby insuring adequate oil delivery to the delivery channel 344 and thus the delivery pump 314. Both angles, θ1, θ2, are desirably less than an angle θ3 defined between the vertical plane V and the horizontal plane H or, in other words, less than 90°. Desirably, as illustrated in FIG. 17, the rearward most surface of the delivery port 390 is inclined at a similar angle as the forward surface.

Thus, the delivery port 390 may be tapered, or inclined, only along the lateral axis of the watercraft 30. Alternatively, the delivery port 390 may be tapered both along the lateral axis and the longitudinal axis of the watercraft 30. The angle θ2 may vary, thereby creating an oval or oblong cross-sectional shape of the delivery port 390. The angle θ2 may alternatively be consistent along the entire surface of the delivery port 390, thereby creating a conical shape of the delivery port 390.

With reference to FIGS. 15–20, a baffle plate 400 is disposed within the reservoir 270 to inhibit oil from sloshing upward and away from the oil delivery port 390 in response to the movements of the watercraft 30. The baffle 400 is preferably a relatively flat, plate-like member positioned within a lower portion of the reservoir 270 and spaced above the oil delivery port 390. The baffle 400 is mounted upon a plurality of mounting posts 402 extending upward from a lower end of the reservoir body 370. A plurality of bolts 404 secure the baffle 400 to the posts 402.

With reference to FIG. 18, the outer periphery of the baffle 400 generally corresponds to the shape of the interior of the tank body 370 of the reservoir 270. The baffle plate 400 additionally includes a strengthening rib 406 which provides stiffness to the baffle 400 in response to vertical forces. Thus, flexing of the baffle 400 may be substantially prevented due to movement of the oil within the reservoir 270.

The baffle 400 includes an aperture 408 positioned generally in a central portion of the baffle 400 to permit oil to flow from a portion of the reservoir 270 above the baffle 400 to a portion of the reservoir 270 below the baffle 400, where it is available for the oil delivery port 390. Thus, oil is able to pass through the baffle 400 relatively quickly when necessary to prevent starving of the oil pump 286.

In addition, the baffle 400 includes a pair of substantially rectangular through-holes 410 spaced on either side of the central aperture 408. Desirably, the through-holes 410 are formed by a stamping process such that three edges of each rectangular through-hole 410 are cut and the material is bent about the remaining, uncut edge to form a downwardly bent portion 412. Desirably, the portions 412 are bent about the inward edge such that fluid below the baffle 400 between the through-holes 410 is inhibited from passing upward through the through-holes 410 by the presence of the downward projecting portions 412. Thus, fluid is permitted to flow easily from above the baffle 400 to below the baffle 400 while having to flow around the bent portions 412 to move upward past the baffle 400. In this manner, upward flow of oil past the baffle 400 is inhibited, thereby ensuring an ample supply of oil is available for the delivery to the oil pump 286, even when the watercraft 30 rapidly changes direction and/or velocity.

Figure 22:
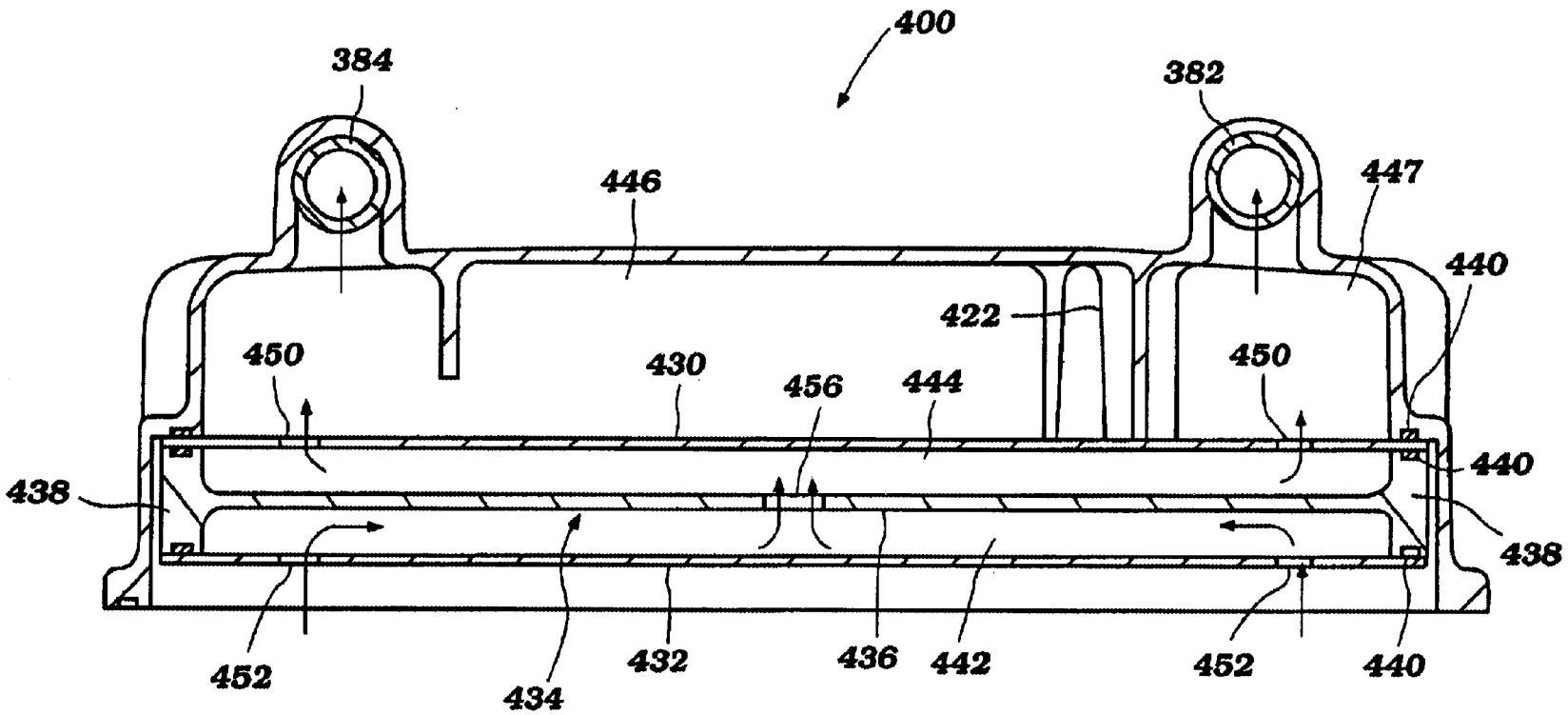
FIG. 22 is a cross-sectional view of the reservoir taken along the line 22—22 of FIG. 24 and showing the upper baffle arrangement of FIG. 16, which includes an upper plate, an intermediate plate and a lower plate.

With reference to FIGS. 16 and 21–27, the fluid reservoir 270 additionally includes an upper baffle arrangement 420. The illustrated baffle arrangement 420 is positioned within the lid 372 of the reservoir 270. The baffle arrangement 420 is coupled to a mounting wall portion 422, which spaces the baffle arrangement 420 from an upper end of the lid 372. As illustrated in FIG. 16, a portion of the mounting wall portion 422 is defined by the side wall of the lid 372. The mounting wall 422 also separates the interior of the lid 372 into two chambers, 446, 447 (FIG. 22). A plurality of fasteners, such as bolts 424, secure the baffle arrangement 420 to the mounting wall portion 422.

The baffle arrangement 420 is comprised of a plurality of baffle plates including an upper plate 430, a lower plate 432 and an intermediate plate 434. The upper and lower baffle plates 430, 432 are substantially flat and are spaced from one another by the intermediate baffle plate 434. The intermediate 434 includes a substantially flat central portion 436 surrounded by a peripheral wall portion 438, which is substantially thicker than the central portion 434. Thus, the upper and lower baffle plates 430, 432 are spaced from the central portion 436 of the intermediate baffle plate 434 by the peripheral wall 438. Seal members 440 are desirably positioned between the intermediate plate 434 and both the upper and lower baffle plates 430, 432 and between the upper baffle plate 430 and the mounting portion 422 of the lid 372 to prevent the passing of fluid therebetween.

With reference to FIG. 22, the baffle plates 430, 432, 434 and the lid 372 define a plurality of breather chambers therebetween. A first breather chamber 442 is defined between the lower baffle plate 432 and the intermediate baffle plate 434. A second breather chamber 444 is defined between the intermediate baffle plate 436 and the upper baffle plate 430. The breather chambers 446, 447 are defined between the upper baffle plate 430 and an upper surface of the lid 372. The breather chambers 446, 447 are separated by the baffle arrangement 420 and the mounting wall portion 422, as described above.

Figure 27:
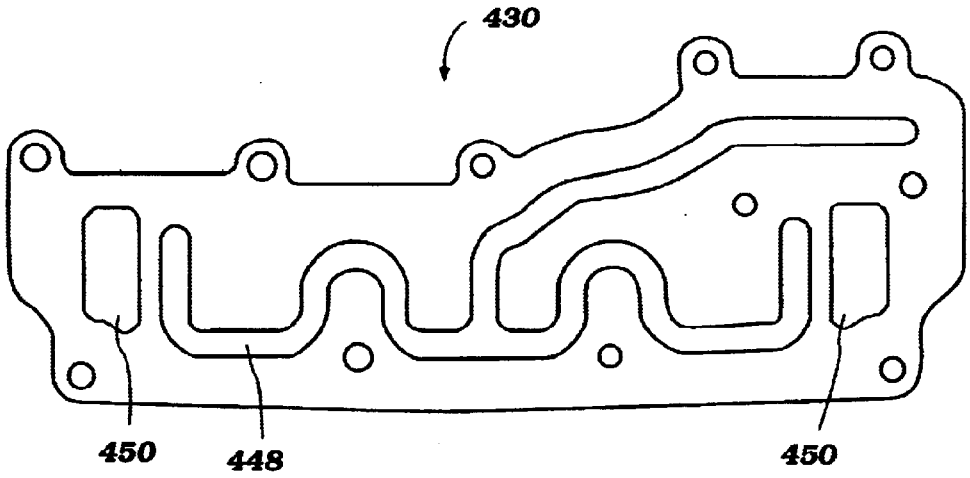
FIG. 27 is a bottom plan view of the upper plate of the upper baffle arrangement of FIG. 16, removed from the reservoir lid.

With reference to FIGURE 27, the upper baffle plate 430 is shown unassembled from the lid 372. The baffle plate 430 desirably includes a strengthening rib 448 to provide the plate 430 with increased stiffness to prevent flexing of the plate in response to vertical forces which may result from movement of fluid with respect to the plate 430. In addition, the upper baffle plate 430 includes a pair of through-holes 450 positioned on opposite lateral ends thereof. The through-holes 450 permit oil mist, blow-by gases and oil to pass through the baffle plate 430. With reference to FIG. 22, the lower baffle plate 432 is desirably substantially identical to the upper baffle plate 430 and also includes a pair of through-holes 452. The through-holes 452 are also desirably positioned on opposing lateral ends of the lower baffle plate 432 and are generally aligned with the through-holes 450.

Figure 26:
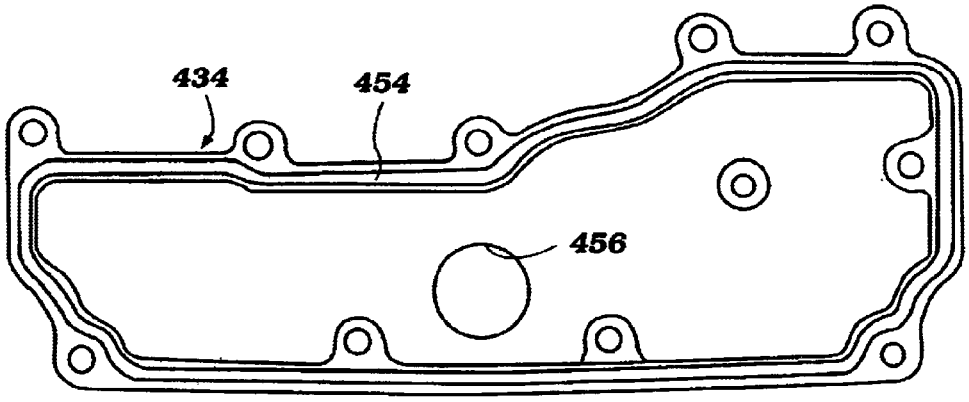
FIG. 26 is a bottom plan view of the intermediate plate of the upper baffle arrangement of FIG. 16, removed from the reservoir lid.

With reference to FIG. 26, the bottom surface of the intermediate baffle plate 434 is shown, with the plate 434 being removed from the lid 372. Desirably, the intermediate baffle plate 434 includes a groove 454 in a lower surface of the peripheral wall 438 for receiving the seal member 440. A similar groove is also defined in an upper surface (not shown) of the peripheral wall 438 to receive the upper seal member 440. The intermediate plate 434 also includes a circular aperture 456 which is generally positioned centrally within the central plate portion 436 of the baffle plate 434.

With reference to FIG. 22, the through-holes 452 of the lower baffle plate 432 permit fluids, including oil mist, blow-by gases and oil, to pass therethrough. However, further vertical movement of the fluid is blocked by the central plate portion 436 of the intermediate baffle plate 434. The fluid must move from the through-holes 452 positioned on opposing lateral ends of the baffle plate 432 towards the aperture 456 which is centrally located in the intermediate baffle plate 434 to move from the breather chamber 442 to the breather chamber 444. Once fluid reaches the breather chamber 444, further vertical movement is blocked by the central portion of the upper baffle plate 430 and the fluid must travel towards the through-holes 450 located at the lateral ends of the upper baffle plate 430 to move into the breather chamber 446 or 447. Such a staggered arrangement of the through-holes 450,452 and aperture 456 permits gaseous fluids, such as oil mist and blow-by gases, to move from within the main reservoir body 370 through the breather chambers 442, 444 and into the breather chamber 446 with relative ease. However, lubrication oil is inhibited from moving through the breather chambers 442, 444 and into the breather chamber 446 or breather chamber 447.

As described above, a pair of breather ports 382, 384 communicate with the interior of the reservoir 270 and, specifically, the breather chambers 446 and 447. Desirably, breather port 382 communicates with breather chamber 447. A breather tube 460 defines a breather chamber which extends from the breather port 382. Preferably, the breather tube 460 connects the breather port 382 to the intake system of the engine 32, such as through the inlet port 200 (FIG. 3).

Preferably, breather port 384 communicates with breather chamber 446. A breather hose 462 extends from the breather port 384. Desirably, the breather hose 462 connects the breather port 384 to a portion of the lubrication system, such as the camshaft chamber within the cylinder head 96 (FIG. 3).

Figure 23:
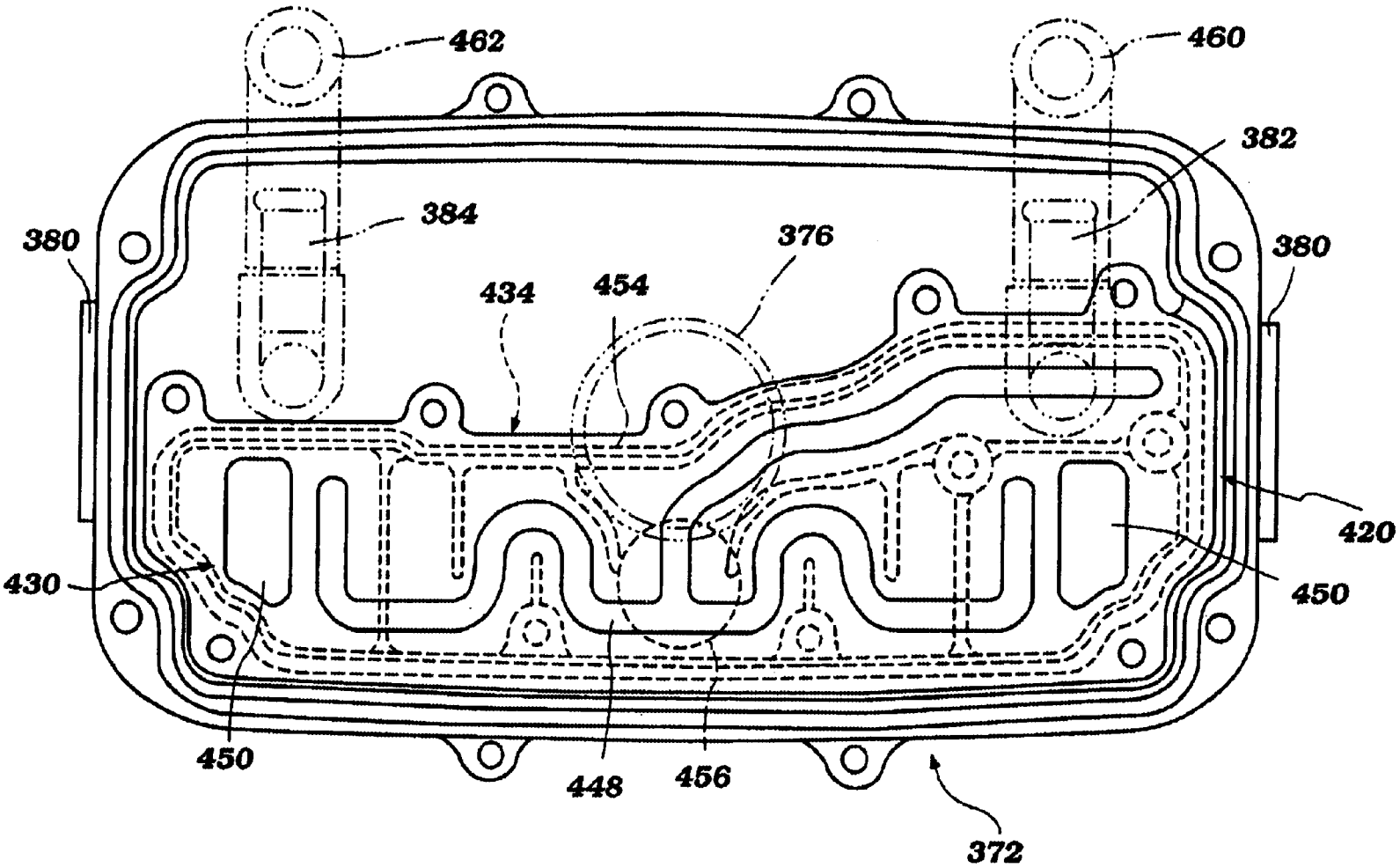
FIG. 23 is a bottom plan view of the lid of the reservoir illustrating the upper baffle arrangement of FIG. 16. The breather ports of FIG. 21 are illustrated in phantom.

With reference to FIG. 23, the baffle arrangement 420 is shaped to occupy approximately one-half of the cross-sectional area of the lid 372. The baffle arrangement 420 is configured such that fluid within the reservoir 270 may pass directly into the breather port 384 while fluid within the reservoir 270 must pass through the baffle arrangement 420 to reach the breather port 382.

Figure 24:
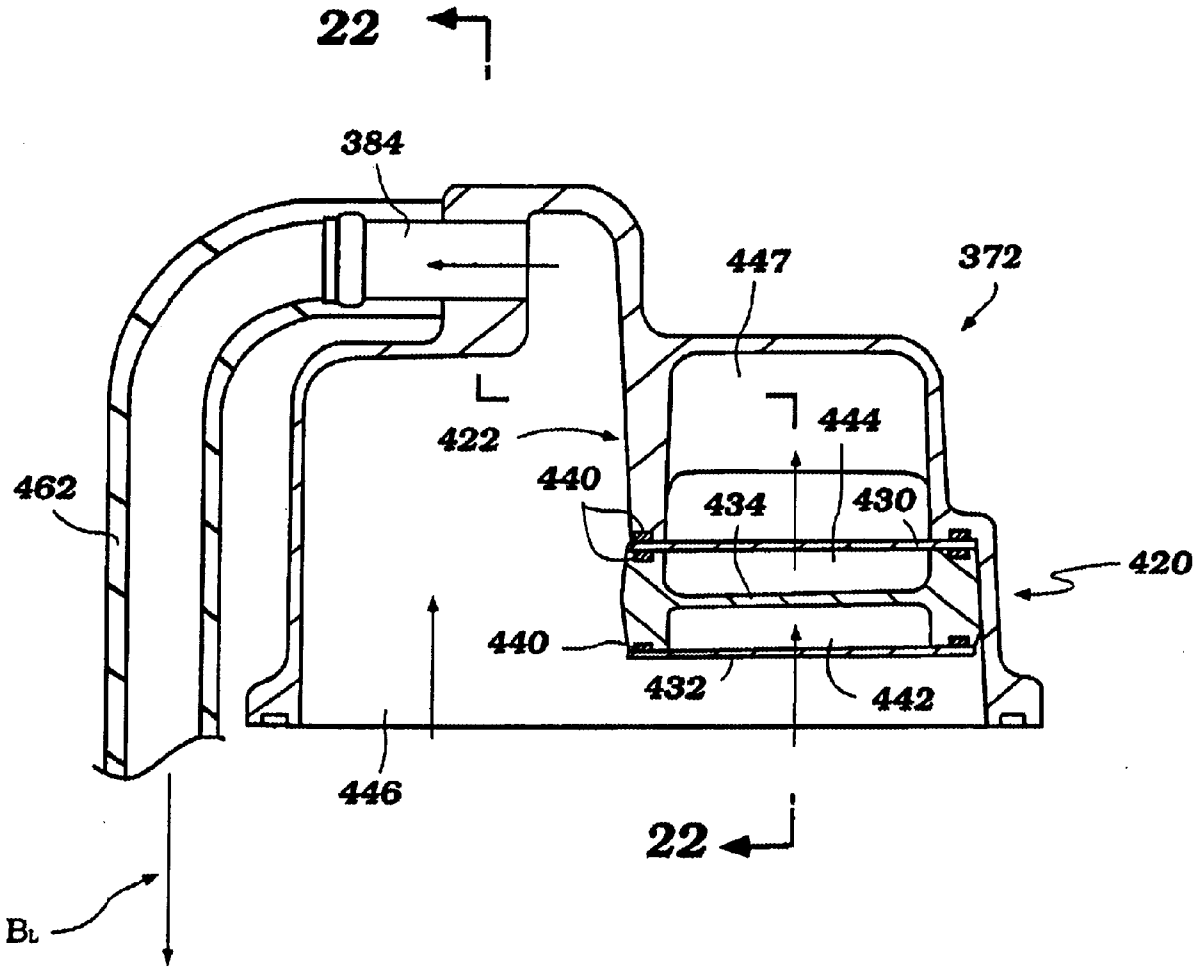
FIG. 24 is a cross-sectional view of the reservoir lid taken along line 24—24 of FIG. 21.

With reference to FIG. 24, fluid within the reservoir 270 may pass directly through the breather port 384 and into the breather passage B1 defined by the breather tube 462. Fluid within the breather passage B1 is then reintroduced into the lubrication system, such as into the crankcase 100, for example. Fluid may enter the breather passage B1 through splashing of fluid within the reservoir 270 during normal operation of the watercraft 30 or it may enter if the watercraft 30 becomes inverted.

Figure 25:
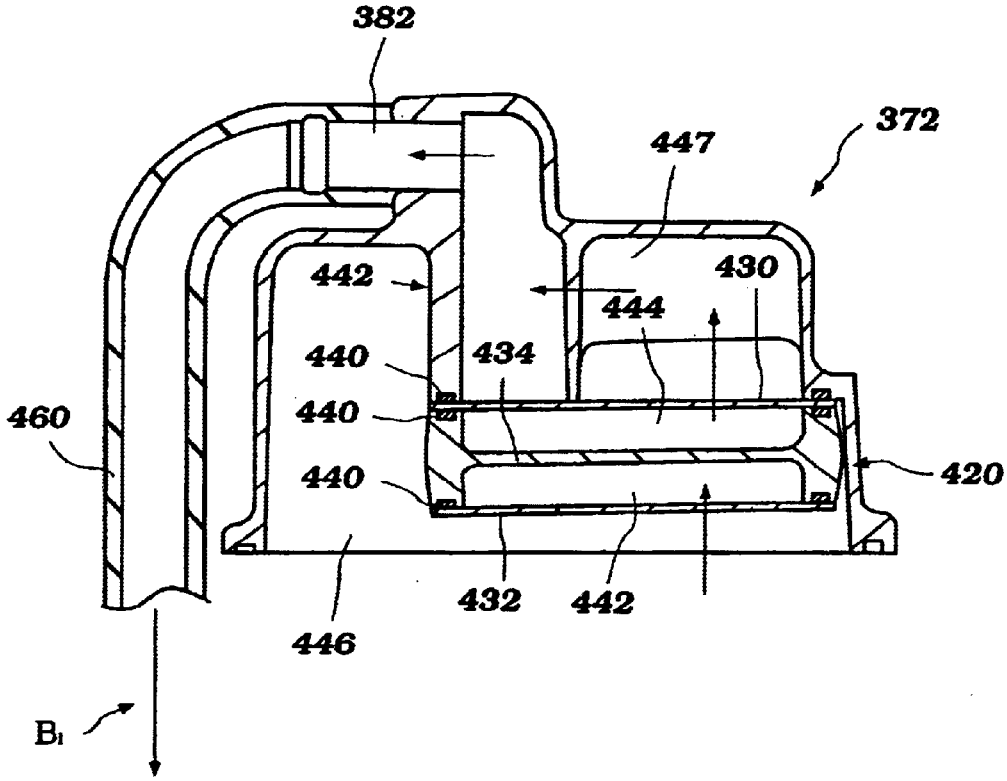
FIG. 25 is a cross-sectional view of the reservoir lid taken along line 25—25 of FIG. 21.

With reference to FIG. 25, fluid within the reservoir 270 must pass through the baffle arrangement 420 before reaching the breather port 382. As described above, baffle arrangement 420 advantageously inhibits passing of oil therethrough while permitting gaseous fluid, such as oil mist and blow-by gases, to pass therethrough. The oil mist and blow-by gases may move through the breather passage B2 and into the intake system, as described above. In this manner, oil mist and blow-by gases are combusted within the engine 32, while lubrication oil is returned to within the reservoir 270 and not unnecessarily combusted.

Figure 9:
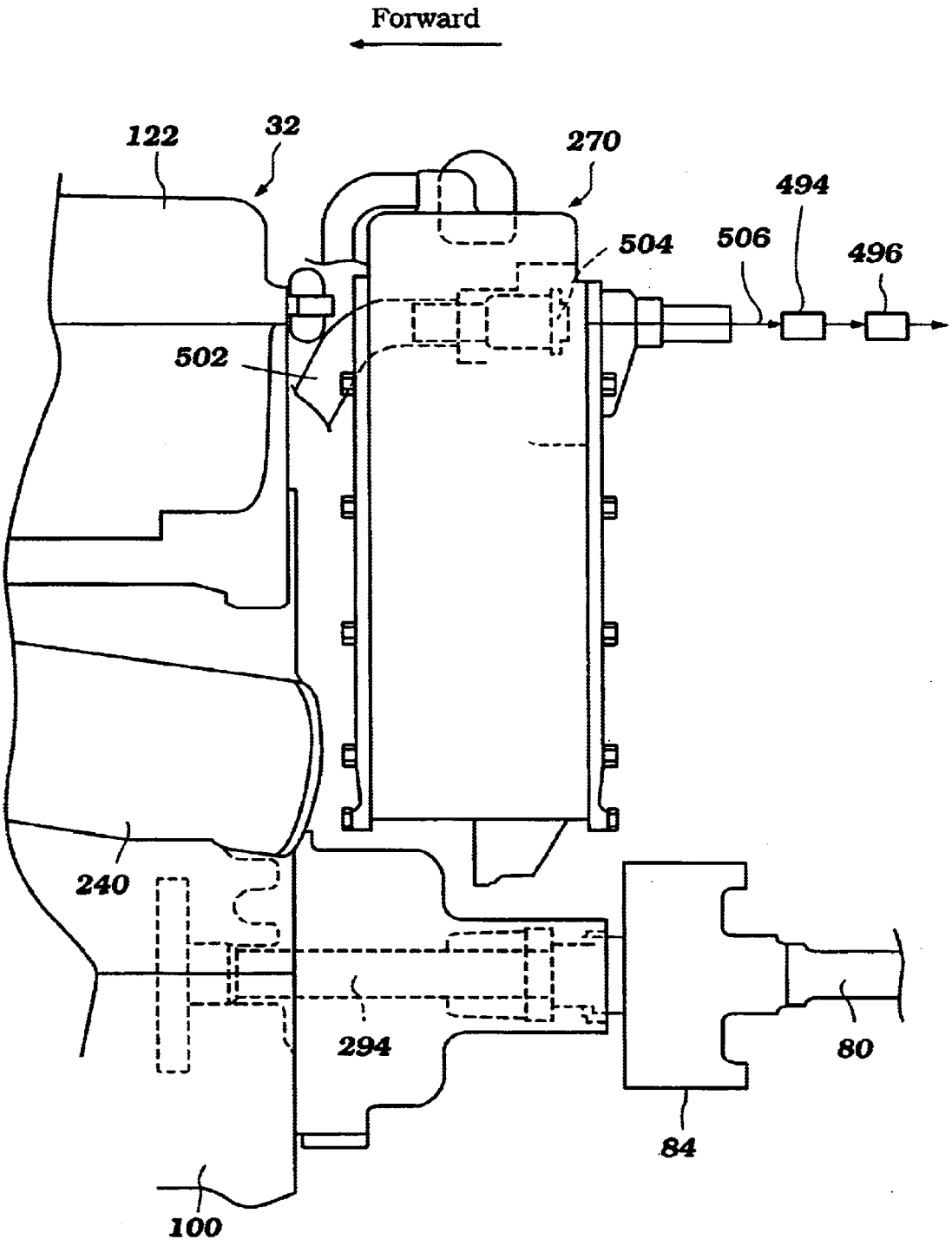
FIG. 9 is an enlarged port side elevational view of the reservoir of FIG. 7.

With reference to FIGS. 7–9, the general arrangement of the cooling system is described in greater detail. As described above, the engine cooling system desirably is separate from the exhaust cooling system. The exhaust cooling system includes a coolant supply system 470 which comprises an exhaust coolant supply passage 472. The exhaust coolant supply passage 472 supplies cooling water from the coolant pump to the water jackets 248 (FIG. 3) of the exhaust manifold 231 and exhaust conduits 236, 238 240. The cooling water circulates through the exhaust system and exits through an outlet port 474 into an outlet channel 476. The outlet channel 476 extends to a discharge port (not shown) to expel the cooling water into the body of water in which the watercraft 30 is operating. Preferably, such a discharge port is in the form of a tell-tale port which opens from the hull 34 of the watercraft 30 at a position above the waterline so as to be visible to an operator of the watercraft 30.

The engine cooling system includes an engine coolant supply system 480 which includes a supply passage 482 that receives a supply of cooling water from the coolant pump. The supply passage 482 splits into a pair of branch passages 484, 486. The passage 484 connects the supply passage 482 with a connector 488 which communicates with water jackets formed within the reservoir 270, as is described below in greater detail. Cooling water moves through the water jackets of the reservoir 270 and exits through a connector 490 into a discharge passage 492. The discharge passage 492 desirably delivers the cooling water to a drain pipe 494 which, may be the water jacket 248 (FIG. 3) of the exhaust conduit and, more specifically the second unitary exhaust conduit 238. The drain pipe 494 terminates at a discharge port 496. The discharge port 496 desirably coincides with the exhaust discharge (not shown) located in a submerged position within the tunnel 74, as is known in the art.

The branch supply passage 486 connects the supply passage 482 with a connector 500 which is in communication with water jackets within the engine body 108. The cooling water circulates within the engine body 108 and exits into a discharge passage 502. The discharge passage 502 communicates with a temperature dependent valve, or thermostat 504. The thermostat 504 substantially prevents fluid below a predetermined temperature from passing therethrough while permitting cooling water above the predetermined temperature to pass into a discharge passage 506. In this manner, the thermostat 504 operates to regulate the operating temperature of the engine 32. The discharge passage 506 connects to the drain pipe 494 wherein the cooling water is discharged from the cooling system as described immediately above.

The illustrated connector 500 additionally incorporates a pressure sensitive valve 510 which is configured to open when the pressure of the cooling water within the branch supply passage 486 exceeds a predetermined threshold pressure. When the valve 510 is open, cooling water is permitted to bypass the engine body 108 through a bypass passage 512. The bypass passage 512 connects the branch passage 486 to a connector 514 which communicates with water jackets within the reservoir 270. The cooling water introduced from the bypass passage 512 thus mixes with cooling water delivered to the reservoir 270 through the branch passage 484 and is evacuated from the reservoir 270 in the same manner. Preferably, the predetermined opening pressure of the valve 510 is below a fluid pressure which may cause damage to the thermostat 504. With such an arrangement, damage to the thermostat 504 due to excessive fluid pressure within the cooling system is substantially prevented.

With reference FIGS. 15, 16 and 28–30, the coolant passage, or water jacket, arrangement within the oil reservoir 270 is described in detail. As described above, cooling water is introduced into cooling passages, or water jackets, formed within the oil reservoir 270. The water jackets are in thermal communication with oil within the reservoir 270. The cooling water enters the water jacket arrangement of the reservoir 270 through a pair of inlet ports 520, 522 which communicate with coolant passages 484, 512, respectively. Thus, cooling water supplied to the branch coolant passage 484 by the coolant pump is delivered to the reservoir 270 through the inlet 520. Similarly, cooling water introduced into the bypass passage 512 by the pressure actuated valve 510 is delivered to the reservoir 270 through the inlet port 522.

Preferably, the inlets 520, 522 are positioned near a lower end of the reservoir 270. The water jacket arrangement of the reservoir 270 is constructed such that cooling water moves around the periphery of the oil reservoir 270 from a bottom portion toward a top portion of the reservoir 270. Once the cooling water reaches the top portion of the reservoir 270, it is evacuated therefrom through an outlet port 524, which communicates with discharge passage 492. From discharge passage 492, the cooling water is discharged from the watercraft 30 in a suitable manner, as described above.

With reference to FIG. 16, a pair of cover members 530, 532 are coupled to front and rear walls 534, 536 of the reservoir 372, respectively, to form front and rear portions 538, 540 of the water jacket. The covers 530, 532 are preferably coupled to the reservoir 270 by fasteners, such as bolts 542 threaded into bolt holes 544 (FIGS. 28 and 29).

Figure 28:
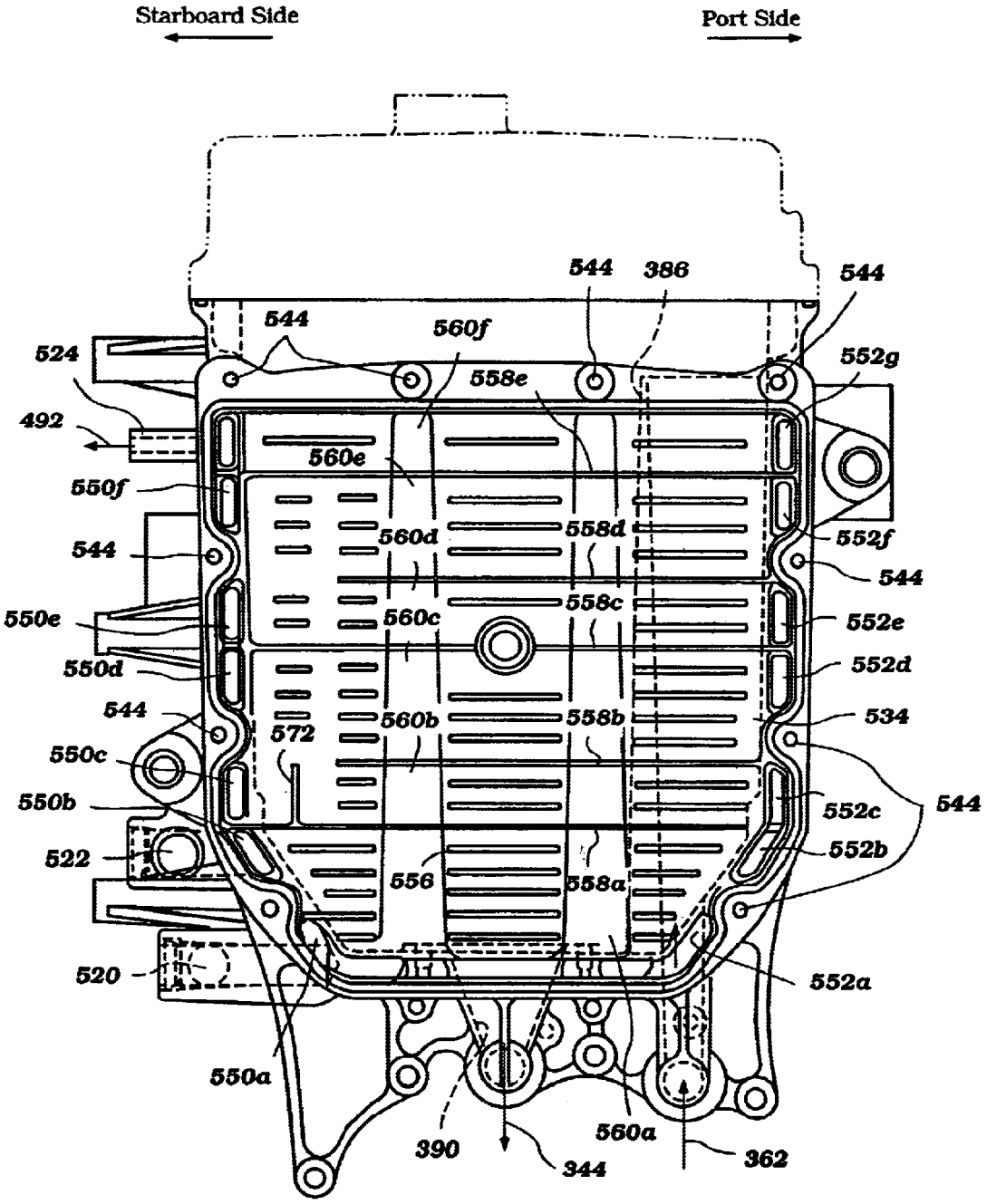
FIG. 28 is a front elevational view of the reservoir with the rear cover member removed and showing the cooling rib arrangement of the rear water jacket portion.
Figure 29:
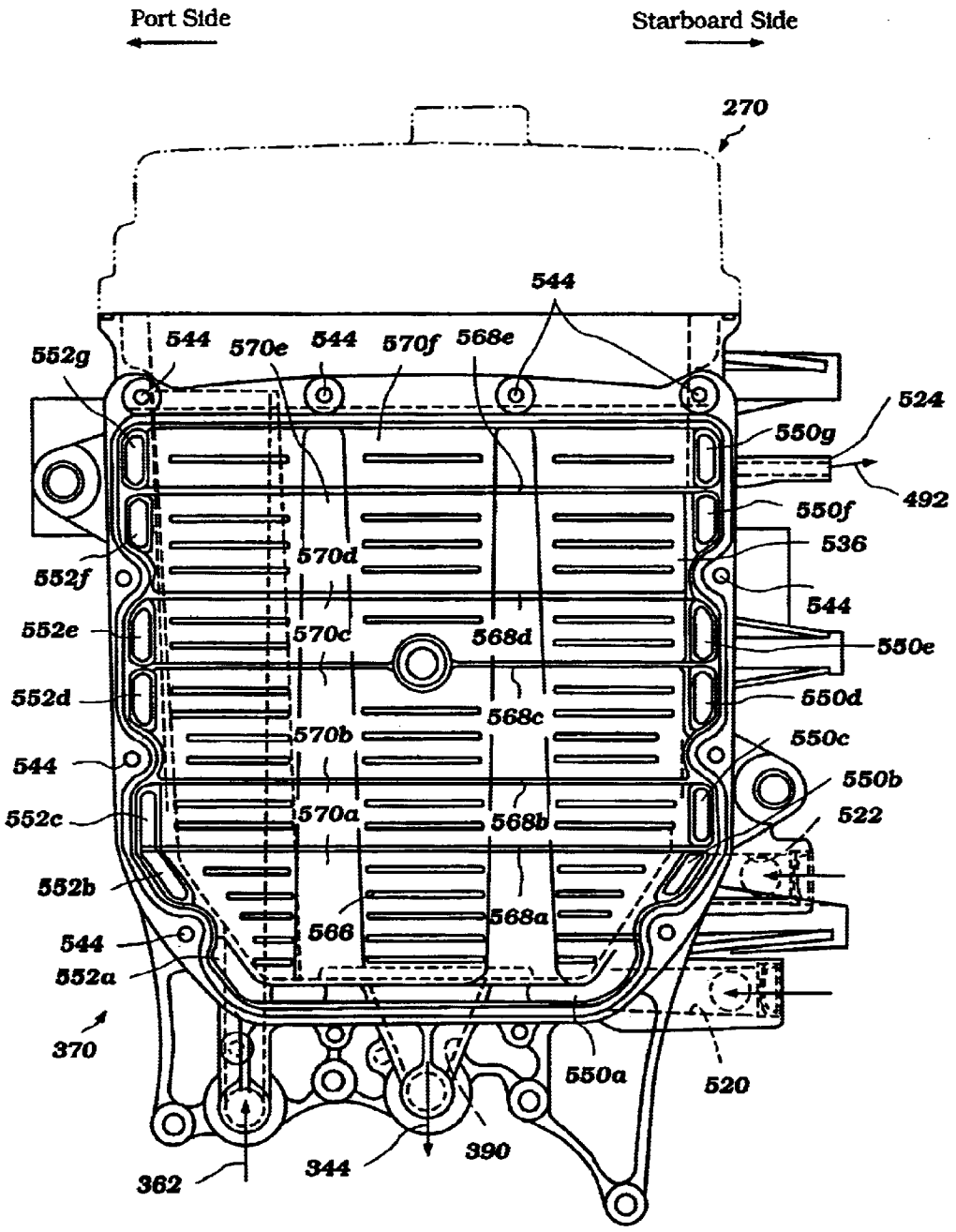
FIG. 29 is a rear elevational view of the reservoir with the front cover member removed and showing the cooling rib arrangement of the front water jacket portion.

With reference to FIGS. 28 and 29, the covers 530, 532 are desirably sized and shaped to substantially cover the front and rear walls 534, 536, including side water jacket portions, generally referred to by the reference numerals 550 and 552. The side portions 550, 552 communicate with both the front water jacket portions 538 and the rear water jacket portions 540.

FIGS. 28 and 29 are front and rear elevational views, respectively, of the reservoir 270 with the front and rear cover members 530, 532 removed. With reference to FIG. 28, the front wall 534 includes a plurality of shorter ribs, or guide ribs 556 and a plurality of longer ribs, or separator ribs, generally referred to by the reference numeral 558. The guide ribs 556 are arranged to guide the cooling water in a horizontal direction while the separator ribs 558 divide the front water jacket 538 into a plurality of distinct horizontal regions, generally referred to by the reference numeral 560.

As illustrated in FIG. 16, the separator ribs 558 extend substantially entirely through the water jacket portion 538 to create separate horizontal regions within the water jacket portion 538. Preferably, the ribs 558 are comprised of separate rib portions which extend from the wall 534 and the cover member 530, respectively.

The guide ribs 556 do not extend entirely through the front water jacket portion 538. Desirably, the guide ribs 556 do not extend past a plane defined by an outer surface of the reservoir 270. A plurality of ribs (not shown) also extend from the inner surface of the cover member 530 and are aligned with the guide ribs 556. Preferably, the opposing surfaces of these ribs and the guide ribs 556 are spaced from one another. That is, a gap preferably is defined therebetween.

Advantageously, the cross-sectional area of each region 560 is substantially equal to, or less than, the cross-sectional area of the passages 484, 512 (FIG. 8) that supply cooling water to the reservoir 270. As a result, the flow rate of the cooling water does not slow substantially upon entering the water jackets 538, 540 of the reservoir 270. This results in improved cooling of the oil within the reservoir 270.

The side water jacket portions 550 on the starboard side of the reservoir 270 includes seven individual passages 550*a*–550*g*. The side water jacket portions 552 on the port side of the reservoir 270 include seven individual passages 552*a*–552*g*. Some of the passages 550*a*–550*g*, 552*a*–552*g* are desirably interconnected, as is described below.

The front wall 534 of the reservoir 270 includes five separator ribs, 558*a*–558*e*. Similarly, the rear wall 536 includes a plurality of guide ribs 566 and five separator ribs 568*a*–568*e* dividing the rear water jacket portion 540 into six distinct horizontal portions 570*a*–570*f*.

In operation, the guide ribs 556, 566 promote horizontal flow of the cooling fluid within the reservoir 270. The ribs 556, 566 increase the surface area of the reservoir body 370 that is in contact with the cooling water thereby increasing the rate of cooling of the oil within the reservoir 270. The arrangement of the separator ribs 558, 568 also encourages upward movement of the cooling water within the reservoir 270.

With additional reference to FIGS. 30*a*–*d*, cooling water enters the starboard side of the reservoir 270 through inlets 520 and 522. Cooling water from the inlet 522 enters the lowermost front water jacket portion 560*a* through passages, or ports, 550*a* and 550*b*. Simultaneously water from inlet 520 enters the lowermost rear water jacket portion 570*a*, also through ports 550*a* and 550*b*. The cooling water moves horizontally toward the port side through the respective water jacket portions 560*a*, 570*a* and meets in the side water jacket portions 552*a*, 552*b*. The meeting of the cooling water within the side water jacket portions 552*a*, 552*b* causes the water to flow upward and reverse direction such that a portion of the cooling water enters the front water jacket portion 560*b* and another portion of the cooling water enters the rear cooling jacket portion 570*b* through side passages 552*c*, as illustrated in FIGS. 30*b* and 30*c*.

The cooling water within the front water jacket portion 560*b* moves horizontally toward the starboard side and encounters a vertical portion 572 of rib 558*a*, which guides the water in an upward direction and into the water jacket portion 560*c*. The cooling water within the rear water jacket portion 570*b* moves toward the starboard side from side water jacket passage 552*c* and through side water jacket portion 550*c* where it is directed upwardly by vertical portion 572 of rib 558*a* to join with cooling water from water jacket portion 560*b*.

The cooling water continues to flow toward the port side of the horizontal portion 560*c* and into the horizontal portion 570*c* of the rear water jacket portion 540 through side passage 552*d*. The cooling water in the horizontal portion 570*c* flows toward the starboard side and into side port 550*d*. From side port 550*d*, cooling water flows into side port 550*e*, which is interconnected with side port 550*d*, and into horizontal portion 570*d* of the rear water jacket 540. Cooling water then flows within portion 570*d* toward the port side, through side port 552*e* and into horizontal portion 560*d* of the front water jacket 538.

The cooling water flows within the portion 560*d* toward the starboard side and curves upward into the horizontal portion 560*e* through an opening in separator rib 558*d*. The cooling water then flows toward the port side within horizontal portion 560*e*, through side port 552*f* and into horizontal portion 570*e* of the rear water jacket 540. The cooling water flows toward the starboard side within horizontal portion 570*e* into side port 550*f* where it is distributed into horizontal portions 560*f* and 570*f* through interconnected side port 550*g*. After flowing through horizontal portions 560*f*, 570*f*, the cooling water is expelled from the reservoir 270 through outlet 524, as illustrated in FIG. 30.

Figure 30:
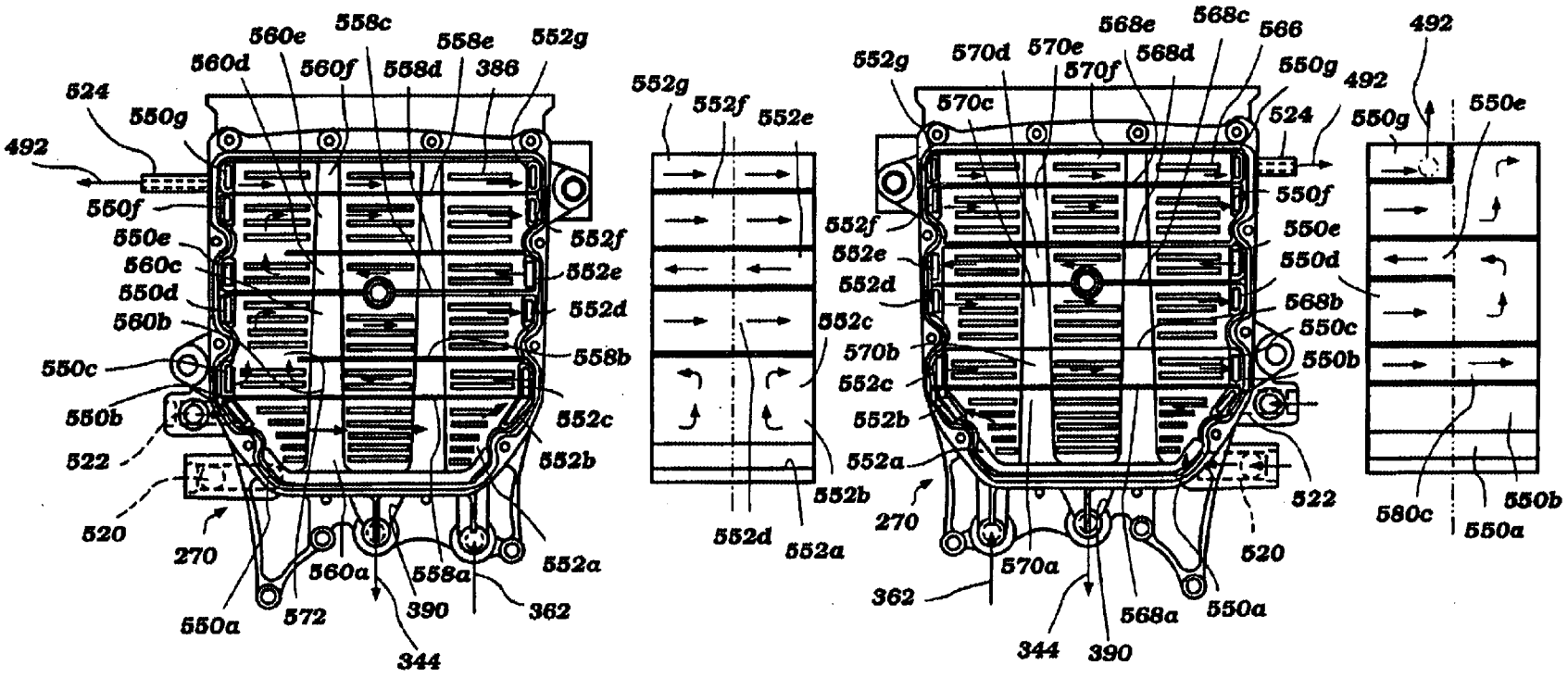
FIGS. 30*a–d* are front, port side, rear and starboard side, respectively, schematic views of the reservoir showing a preferred movement of cooling water through the water jacket.

FIG. 30 illustrates one preferred flow pattern of cooling water within the water jacket of the reservoir 270 to provide advantageous cooling of the lubrication oil therein. The ribs R may take on various alternative arrangements to achieve different cooling objectives, as may be determined by one of skill in the art.

Figure 31:
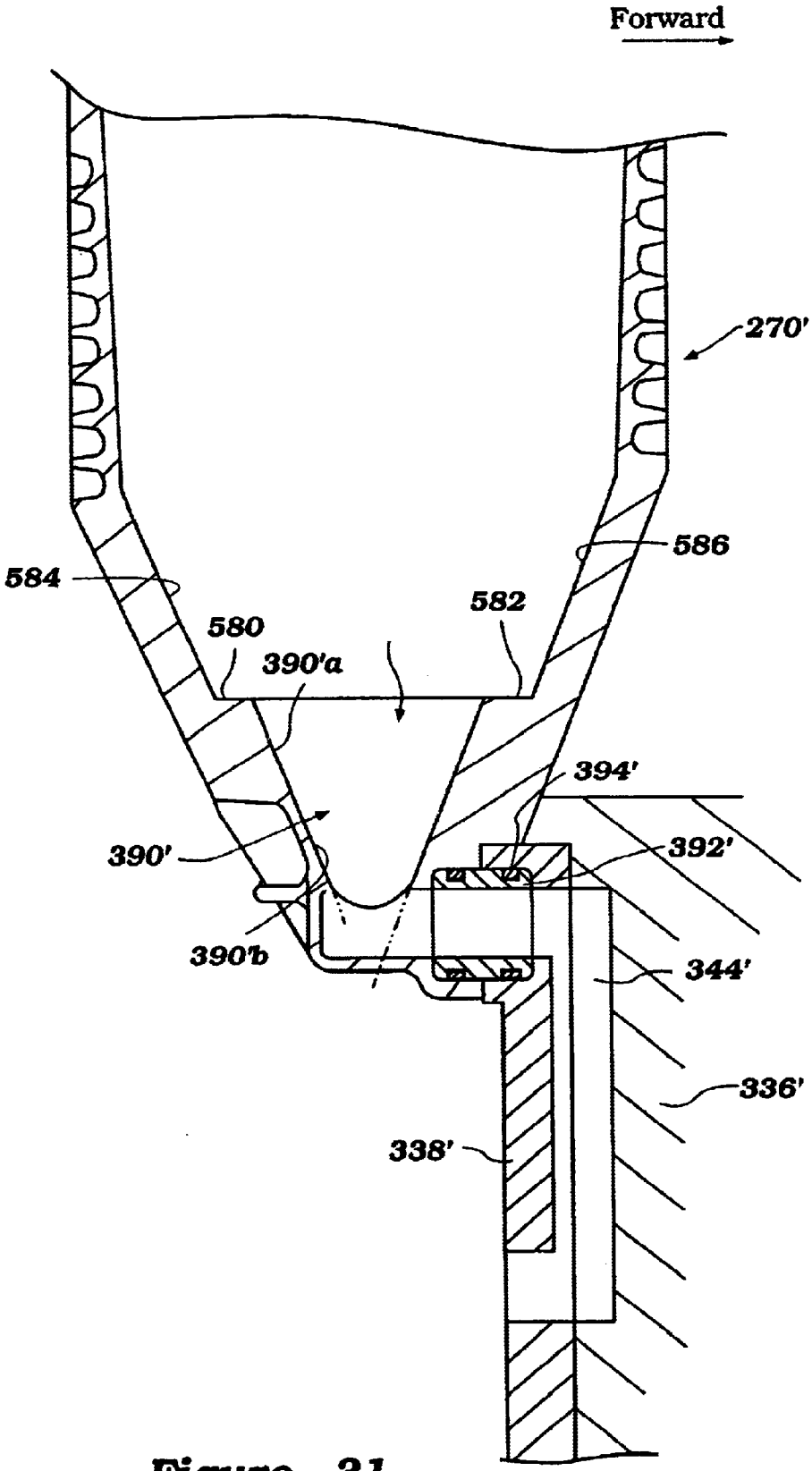
FIG. 31 is a modification of the oil delivery port of FIG. 17.

FIG. 31 illustrates a modification of the oil reservoir 270 described above. The oil reservoir of FIG. 31, referred to generally by the reference numeral 270' is substantially similar to the oil reservoir 270 described above, and therefore, like reference characters will be used indicate like components, except that an (') will be added.

The reservoir 270' includes a delivery port 390' for supplying oil within the reservoir 270' to the oil pump (not shown). The front and rear wall portions of the delivery port 390' are inclined, or tapered, from an inlet portion 390'*a* to an outlet portion 390'*b*. The bottom surface of the reservoir 270' includes flat portions 580, 582 to the front and rear of the delivery port 390, respectively. The flat portions 580, 582 extend into inclined portions 584, 586, respectively, of the oil reservoir 270'.

In operation, the flat portions 580, 582 assist in guiding oil into delivery port 390' when the watercraft 30 is inclined rearwardly (e.g., when up on plane) or inclined forwardly (e.g., as a result of sudden deceleration) by eliminating the "corner" that would exist if the side walls of the reservoir 270' were orthogonal to the flat portions 580, 582 at their intersection. Such a "corner" would tend to retain a certain, minimum amount of oil therein before oil could be provided to the delivery port 390'. With the arrangement of FIG. 31, oil is capable of being supplied to the delivery port 390' at a lower oil level than an arrangement that includes a "corner".

Of course, the foregoing description is that of preferred embodiments of the present invention, and various changes and modifications may be made without departing from the spirit and scope of the invention, as defined by the appended claims.

What is claimed is:

1. A watercraft comprising a hull including a lower portion and an upper portion, an engine compartment defined between the upper and lower portions, a four-cycle internal combustion engine supported within the engine compartment, the engine including an engine body defining at least one combustion chamber therein, and a valve train comprising at least one intake valve configured to control air flow into the combustion chamber and at least one exhaust valve configured to control flow of exhaust gases out of the combustion chamber, an induction system configured to guide air to the engine body, a crankshaft journaled for rotation at least partially within the engine body, a plurality of oil galleries defined within the engine body configured to guide oil to at least portions of the valve train and the crankshaft, an oil reservoir having a removable lid, an oil pump arrangement configured to circulate oil between the reservoir and the oil galleries, and a breather baffle arrangement connected to the lid, the baffle arrangement comprising at least first, second, and third baffle plates, each baffle plate having at least one gas aperture configured to allow a gas to pass therethrough, the apertures in the first and third plates being offset from the aperture in the second plate, a vapor outlet disposed in the lid and positioned such that vapor from the interior of the reservoir must pass through the baffle arrangement in order reach the vapor outlet, wherein the second plate includes a central planar area and a peripheral portion having a thickness greater than a thickness of the central portion.

2. The watercraft according to claim 1, wherein the second plate is between the first and third plates.

3. The watercraft according to claim 1 wherein the peripheral portion defines a spacing between the first and second plates and between the second and third plates.

4. A watercraft comprising a hull, an engine supported by the hull, a lubricant reservoir defining an interior portion configured to pool lubricant for the engine, the reservoir having a vapor outlet, and a breather baffle arrangement disposed between the interior portion and the vapor outlet, the baffle arrangement comprising a plurality of plates, each having an aperture, the apertures on adjacent plates being offset from each other, wherein the baffle arrangement comprises at least first, second, and third plates, wherein the first and third plates are substantially entirely planar, the second plate including a central planar portion and a peripheral portion having a thickness greater than a thickness of the central planar portion.

5. The watercraft according to claim 4, wherein the reservoir comprises a housing, the baffle arrangement being sealed to the housing around a periphery of the vapor outlet, such that vapor from the interior of the reservoir must pass through the baffle arrangement before reaching the vapor outlet.

6. The watercraft according to claim 4, wherein the plates are sealedly engaged with each other around a periphery thereof.

7. The watercraft according to claim 4, wherein the second plate is disposed between the first and third plates.

8. The watercraft according to claim 7, the peripheral portion defining a spacing between the first and second plates and a spacing between the second and third plates.

9. The watercraft according to claim 4, wherein the first and third plates are constructed of a thin sheet material.

10. The watercraft according to claim 4, wherein the reservoir comprises a removable lid, the baffle arrangement being connected to the lid.

11. The watercraft according to claim 4, additionally comprising an oil inlet to the reservoir, an oil outlet of the reservoir, an oil pump arrangement configured to deliver oil to the inlet of the reservoir and to receive oil from the outlet of the reservoir, a second baffle disposed in the interior of the reservoir and positioned between the inlet and the outlet such that oil entering the inlet of the reservoir must pass through the baffle before flowing to the outlet of the reservoir.

12. A lubricant reservoir comprising an interior volume configured to store lubricant, a vapor outlet disposed in an upper portion of the reservoir, and a breather baffle arrangement comprising a plurality of plates, each plate including an aperture, the apertures of adjacent plates being offset from each other, wherein the baffle arrangement comprises at least first, second, and third plates, wherein the first and third plates are substantially entirely planar, the second plate including a central planar portion and a peripheral portion having a thickness greater than a thickness of the central planar portion.

13. The reservoir according to claim 12, wherein the reservoir comprises a housing, the baffle arrangement being sealed to the housing around a periphery of the vapor outlet, such that vapor from the interior of the reservoir must pass through the baffle arrangement before reaching the vapor outlet.

14. The reservoir according to claim 12, wherein the plates are sealedly engaged with each other around a periphery thereof.

15. The reservoir according to claim 12, wherein the second plate is disposed between the first and third plates.

16. The reservoir according to claim 15, the peripheral portion defining a spacing between the first and second plates and a spacing between the second and third plates.

17. The reservoir according to claim 12, wherein the first and third plates are constructed of a thin sheet material.

18. The reservoir according to claim 12, wherein the reservoir comprises a removable lid, the baffle arrangement being connected to the lid.

* * * * *